United States Patent [19]

Furutachi et al.

[11] 4,220,470

[45] Sep. 2, 1980

[54] SILVER HALIDE MATERIAL CONTAINING PHOTOGRAPHIC MAGENTA COUPLER

[75] Inventors: Nobuo Furutachi; Kotaro Nakamura; Atsuaki Arai; Minoru Yamada; Keisuke Shiba, all of Minami-ashigara, Japan

[73] Assignee: Fuji Photo Film Co., Ltd., Ashigara, Japan

[21] Appl. No.: 881,318

[22] Filed: Feb. 27, 1978

Related U.S. Application Data

[63] Continuation of Ser. No. 616,480, Sep. 24, 1975, abandoned.

[30] Foreign Application Priority Data

Sep. 24, 1974 [JP] Japan ..... 49-109822

[51] Int. Cl.[2] ..... G03C 7/00; G03C 1/40

[52] U.S. Cl. ..... 430/387; 430/376; 430/380; 430/381; 430/448; 430/505; 430/508; 430/558

[58] Field of Search ..... 96/100, 100 N, 56.2, 96/56.5, 74

[56] References Cited

U.S. PATENT DOCUMENTS

| | | | |
|---|---|---|---|
| 3,900,483 | 8/1975 | Fujimatsu et al. | 96/100 N |
| 3,926,634 | 12/1975 | Sugizaki et al. | 96/100 |

*Primary Examiner*—Travis Brown

*Attorney, Agent, or Firm*—Sughrue, Rothwell, Mion, Zinn and Macpeak

[57] ABSTRACT

A photographic two-equivalent magenta coupler represented by the following general formula (I):

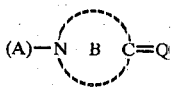

(I)

wherein (A) represents a residue of a magenta color image-forming coupler in which one of the hydrogen atoms in the coupling position is eliminated; Q represents an oxygen atom or NH group; and B represents the non-metallic atoms necessary to form a 5-membered or a 6-membered ring containing the nitrogen atom and the

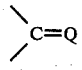

group. Color photographic light-sensitive materials containing the two-equivalent magenta coupler are also described.

15 Claims, No Drawings

SILVER HALIDE MATERIAL CONTAINING PHOTOGRAPHIC MAGENTA COUPLER

This is a continuation of application Ser. No. 616,480 filed Sept. 24, 1975, now abandoned.

BACKGROUND OF THE INVENTION

1. Field of the Invention

The present invention relates to a photographic coupler, and more particularly it relates to a novel class of two-equivalent magenta couplers which are suitable for use in silver halide color photographic light-sensitive materials.

2. Description of the Prior Art

It is known that, in the color development of a silver halide color photographic material an aromatic primary amine color developing agent is oxidized and reacts with a coupler to form a dye, such as an indophenol, an indoaniline, an indamine, an azomethine, a phenoxazine, a phenazine and the like, thus forming a color image. In this type, the subtractive color process is ordinarily used for color reproduction and yellow, magenta and cyan color images are formed, which are respectively the complementary colors to blue, green and red. For example, a coupler of the acylacetanilide or dibenzoylmethane type is used for forming a yellow color image, a coupler of the pyrazolone, pyrazolobenzimidazole, cyanoacetophenone or indazolone type is used for forming a magenta color image and a coupler of the phenol type, such as a phenol or a naphthol, is used for forming a cyan color image.

In one preferred color photographic light-sensitive material, the dye image-forming couplers are incorporated into a silver halide emulsion. Couplers which are incorporated into the emulsion must be rendered non-diffusible (diffusion resistant) in the binder matrix of the emulsion.

The color image-forming couplers of the prior art are almost all four-equivalent couplers, which require theoretically four moles of silver halide as an oxidizing agent for forming one mole of the dye through the coupling reaction. On the contrary, a two-equivalent coupler having an active methylene group which is substituted by a group capable of being released through the coupling of an oxidized product of an aromatic primary amine developing agent requires only the development of two moles of silver halide for forming one mole of the dye. Since the quantity of silver halide required for forming a dye in the case of a two-equivalent coupler is one half of that required in the case of an ordinary four-equivalent coupler, a two-equivalent coupler has many advantages in that a thinner light-sensitive layer can be used and the layer can be processed rapidly. In addition, the photographic properties can be improved and economical advantages can be obtained through a reduction in the layer thickness.

Several attempts have been made to convert 5-pyrazolone-type couplers, which have been conventionally used as a magenta color-forming coupler, to two-equivalent couplers. For example, the 4-position of the pyrazolone has been substituted with a thiocyano group as described in U.S. Pat. Nos. 3,214,437 and 3,253,924, an acyloxy group as described in U.S. Pat. No. 3,311,476, an aryloxy group as described in U.S. Pat. No. 3,419,391, a 2-triazolyl group as described in U.S. Pat. No. 3,617,291, a halogen atom as described in U.S. Pat. No. 3,522,052 and the like.

However, when these 4-position substituted pyrazolone couplers are employed, some disadvantages occur in that a marked color fog is produced, in that the coupling reactivity is insufficient, in that the couplers per se are chemically unstable and change into compounds which cannot form dyes or in that many difficulties are encountered during the preparation of these couplers.

5-pyrazolones in which the 4-position is substituted with an alkylthio group, an arylthio group or a heterocyclic thio group are known, as described in U.S. Pat. No. 3,227,554. However, most of these known thio-substituted pyrazolone compounds have the disadvantages that their reactivity with the oxidation products of an aromatic primary amine color-developing agent is not appropriate, that the mercapto compounds which are formed upon the coupling reaction have such severe photographic effects that they cannot be used in conventional color photographic light-sensitive materials, and that the couplers are chemically unstable.

SUMMARY OF THE INVENTION

Therefore, an object of the present invention is to provide a novel two-equivalent magenta color image-forming coupler in which the coupling position of the magenta coupler is substituted with a group capable of being released by the coupling reaction with an oxidation product of an aromatic primary amine developing agent.

Another object of the present invention is to provide a novel two-equivalent magenta coupler which has a suitable reactivity and which is capable of forming a dye in a high yield and without the formation of undesired stains and fog.

Another object of the present invention is to provide a color photographic light-sensitive material having a silver halide emulsion layer containing a novel magenta color image-forming coupler.

Still another object of the present invention is to provide a method by which the amount of silver halide in the photographic emulsion layer can be reduced and the sharpness of the color image obtained can be improved by the use of a novel magenta color image-forming coupler.

Still another object of the present invention is to provide a color photograph having a durable color image by the use of a novel magenta color image-forming coupler.

A further object of the present invention is to provide a novel two-equivalent magenta coupler which can be prepared in a simple manner and in a high yield.

A further object of the present invention is to provide a novel two-equivalent magenta coupler which has an improved conversion rate to the dye, an excellent resistance to the effects of other chemical compounds, and a good coupling reactivity.

A still further object of the present invention is to provide a method of forming a dye image in the presence of a novel two-equivalent magenta coupler in which the coupling position of the magenta color image-forming coupler is substituted with a group capable of being released by the coupling reaction with an oxidation product of an aromatic primary amine developing agent.

A still further object of the present invention is to provide a method of forming a dye image by processing an exposed silver halide photographic light-sensitive material in the presence of a novel two-equivalent magenta coupler in which the coupling position of the magenta color image-forming coupler is substituted with a group capable of being released by the coupling reaction with an oxidation product of an aromatic primary amine developing agent.

A further object of the present invention is to provide a color developer containing an aromatic primary amine developing agent and a novel 2-equivalent magenta coupler as above defined.

These objects of the present invention are accomplished by using a photographic magenta coupler represented by the following general formula (I):

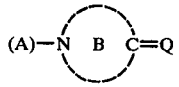

(I)

wherein (A) represents a residue of a magenta color image-forming coupler in which one of the hydrogen atoms in the coupling position is replaced by the

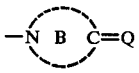

moiety; Q represents an oxygen atom or NH group; and B represents the non-metallic atoms necessary to form a 5-membered or a 6-membered ring containing the nitrogen atom and the

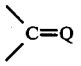

group.

These and other objects of the present invention will be explained in more detail by the following detailed description and examples.

DETAILED DESCRIPTION OF THE INVENTION

A feature of the present invention is that the photographic magenta coupler represented by the general formula described above is a two-equivalent magenta coupler from which the

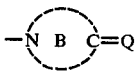

moiety in the general formula is released upon oxidative coupling with an aromatic primary amine developing agent to form a magenta dye, and stoichiometrically requires only two mole-equivalents of an oxidizing agent, such as silver halide, for forming one mole of a magenta dye.

The objects of the present invention are advantageously accomplished in one embodiment of the present invention with a multi-layer color photographic light-sensitive material comprising a support having thereon at least one silver halide emulsion layer containing a two-equivalent magenta coupler represented by the general formula (II) or (III) set forth below.

In another embodiment, these objects are accomplished by a method of forming images which comprises developing an exposed color photographic light-sensitive material comprising a support having thereon at least one silver halide emulsion layer with an aromatic primary amine color-developing agent in the presence of a two-equivalent magenta coupler represented by the general formula (II) or (III) set forth below.

In a further embodiment, the objects are accomplished with a color developer solution containing an aromatic primary amine color developing agent and a two-equivalent magenta coupler represented by the general formulae (II) or (III).

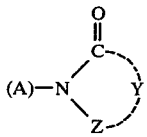

(II)

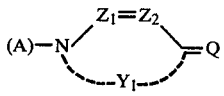

(III)

wherein (A) represents a residue of a magenta color image-forming coupler in which one of the hydrogen atoms of the coupling position is replaced by the

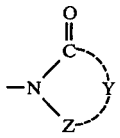

moiety or the

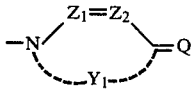

moiety; Y represents the non-metallic atoms necessary to form a 5-membered ring or a 6-membered ring and is selected from an alkylene group (which term includes a substituted alkylene group), an alkenylene group (which term includes a substituted alkenylene group), an oxygen atom, a sulfur atom, an imino group (which term includes a substituted imino group), a methine group (which term includes a substituted methine group), a sulfonyl group, a sulfoxide group and —N=, and where the ring can be a condensed ring system, for example, a 5- or 6-membered ring which is a saturated or unsaturated aliphatic ring or an aromatic ring consisting of carbon atoms and which can contain at least one hetero atom selected from N, O and S, such as a cyclopentane, a cyclohexane, a cyclopentene, a cyclohexene, a benzene, a pyridine, a furan, a thiophene, a morpholine, a piperidine, etc.; Z represents a sulfoxide group, a methylene group (which term includes a substituted methylene group), —N=, an imino group (which term includes a substituted imino group), a methine group, (which term includes a substituted methine group), an oxygen atom or a sulfur atom; $Z_1$ and $Z_2$, which may be the same or different, each represents a methine group (which term includes a substituted methine group) or —N=, and the nitrogen containing ring composed of $Z_1$ and $Z_2$ can be a condensed ring system, for example, a 5- or 6-membered ring which is an unsaturated aliphatic ring or an aromatic ring consisting of carbon atoms and which can contain at least one hetero atom selected from N, O and S; Q represents an oxygen atom or an imino group; and $Y_1$ represents an ethylene group (which term includes a substituted ethylene group), an oxygen atom, a sulfur atom, an imino group (which term includes a substituted imino group), a methylene group (which term includes a substituted methylene group) or an alkenylene group (which term includes a substituted alkenylene group).

Any residue of a magenta color image-forming coupler can be used for (A) in the above formulae, but a 5-oxo-4-pyrazolinyl group, an α-cyano-α acylmethyl group or a 3-pyrazolo[1,5-a]-benzimidazolyl group is preferred.

Further, particularly useful and preferred couplers of the present invention have the following general formulae (IV) to (VII):

(IV)

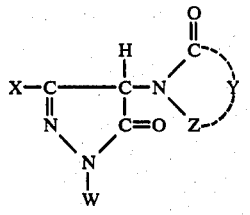

(V)

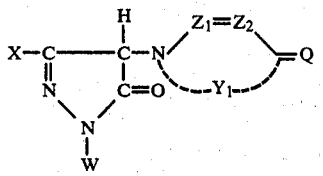

(VI)

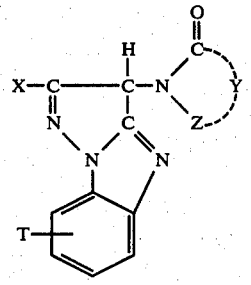

(VII)

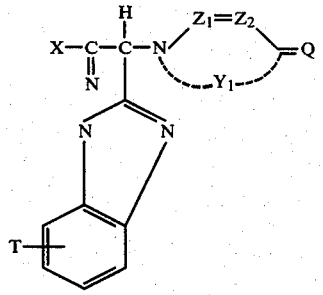

In the above general formulae, W represents a hydrogen atom; or has up to 40 carbon atoms, preferably up to 22 carbon atoms. Suitable examples of groups for W include a straight chain or branched chain alkyl group (e.g., a methyl, ethyl, isopropyl, tert-butyl, hexyl, dodecyl, docosyl, etc., group), an alkenyl group (e.g., an allyl, β-vinylethyl, etc., group), a cycloalkyl group (e.g., a cyclohexyl, norbornyl, 7,7-dialkylnorbornyl, 2-pentadecyl-7,7-dialkylnorbornyl, etc., group), an aralkyl group (e.g., a benzyl, β-phenylethyl, etc., group) or a cycloalkenyl group (e.g., a cyclopentenyl, cyclohexenyl, etc., group), and these groups as described above can be substituted with one or more of a halogen atom (e.g., a chlorine, bromine, fluorine, etc., atom), a nitro group, a cyano group, an aryl group (e.g., a phenyl, tolyl, methoxyphenyl, naphthyl, etc., group, an alkoxy group (e.g., a methoxy, butoxy, octyloxy, etc., group), an aryloxy group (e.g., a phenoxy, tolyloxy, naphthoxy, etc., group), a carboxyl group, an alkylcarbonyl group (e.g., a methylcarbonyl, octylcarbonyl, etc., group), an arylcarbonyl group (e.g., a phenylcarbonyl, tolylcarbonyl, etc., group), an alkoxycarbonyl group (e.g., a methoxycarbonyl, butoxycarbonyl, etc., group), an aryloxycarbonyl group (e.g., a phenoxycarbonyl, tolyloxycarbonyl, etc., group), a sulfo group, an acyloxy group (e.g., an acetyl group, etc.), a sulfamoyl group (e.g., an N-methylsulfamoyl, N,N-diethylsulfamoyl, N-methyl-N-phenylsulfamoyl, etc., group), a carbamoyl group (e.g., an N-ethylcarbamoyl, N-methyl-N-decylcarbamoyl, N-phenylcarbamoyl, etc., group), an acylamino group (e.g., an acetamido, butyramido, benzamido, etc., group), a diacylamino group (e.g., a phthalimido, 3-heptadecyl succimimido, etc., group), a ureido group (e.g., an ethylureido, phenylureido, chlorophenylureido, etc., group), a thioureido group (e.g., an ethylthioureido, phenylthioureido, chlorophenylthioureido, etc., group), an alkoxycarbonylamino group (e.g., a methoxycarbonylamino, octoxycarbonylamino, etc., group), an aryloxycarbonylamino group (e.g., a phenoxycarbonylamino group, etc.), an alkoxythiocarbonylamino group (e.g., a methoxythiocarbonylamino, octoxythiocarbonylamino, etc., group), an aryloxythiocarbonylamino group (e.g., a phenoxythiocarbonylamino group, etc.), a sulfonamido group (such as an alkylsulfonamido (e.g., methylsulfonamido, ethylsulfonamido, etc.), arylsulfonamido (e.g., phenylsulfonamido, etc.), etc. group), a heterocyclic group (e.g., a 5- or 6-membered heterocyclic group or condensed heterocyclic group containing at least one hetero atom selected from nitrogen, oxygen and sulfur atoms, such as a furyl, oxazolyl, benzothiazolyl, imidazolyl, etc., group), an arylsulfonyloxy group (e.g., a phenylsulfonyloxy, tolylsulfonyloxy, etc., group), an alkylsulfonyloxy group (e.g., an ethylsulfonyloxy, dodecylsulfonyloxy, etc., group), an arylsulfonyl group (e.g., a phenylsulfonyl, tolylsulfonyl, etc., group), an alkylsulfonyl group (e.g., a methylsulfonyl, octylsulfonyl, etc., group), an arylthio group (e.g., a phenylthio, tolylthio, etc., group), an alkylthio group (e.g., a methylthio, octylthio, dodecylthio, etc., group), an alkylsulfinyl group (e.g., a methylsulfinyl, hexylsulfinyl, etc., group), an arylsulfinyl group (e.g., a phenylsulfinyl, tolylsulfinyl, etc., group), an alkylamino group (e.g., a methylamino, butylamino, etc., group), an dialkylamine group (e.g., an N,N-diethylamino, N-methyl-N-decylamino, etc., group), an anilino group (such as an anilino, an N-alkylanilino (e.g., N-methylanilino, etc.), N-arylanilino (e.g., N-phenylanilino, etc.), N-acylanilino (e.g., 2-chloro-5-tetradecanamidoanilino, etc.), etc., group, a hydroxyl group, or a mercapto group.

Furthermore, W represents an aryl group (e.g., a phenyl or an α- or β-naphthyl group) or an aryl group having one or more substituents such as an alkyl group (e.g., a methyl, ethyl, octyl, etc., group), an alkenyl group (e.g., an allyl, β-vinylethyl, etc., group), a cycloalkyl group (e.g., a cyclohexyl, norbornyl, 7,7-dialkylnorbonyl, 2-pentadecyl-7,7-dialkylnorbornyl, etc., group), an aralkyl group (e.g., a benzyl, β-phenylethyl, etc., group), an cycloalkenyl group (e.g., a cyclopentenyl, cyclohexenyl, etc., group), a halogen atom (e.g., a chlorine, bromine, fluorine, etc., atom), a nitro group, a cyano group, an aryl group (e.g., a phenyl, tolyl, methoxyphenyl, naphthyl, etc., group), an alkoxy group (e.g., a methoxy, butoxy, octyloxy, etc., group), an aryloxy group (e.g., a phenoxy, tolyloxy, naphthoxy, etc., group), a carboxy group, an alkylcarbonyl group (e.g., a methylcarbonyl, octylcarbonyl, etc., group), an arylcarbonyl group (e.g., a phenylcarbonyl, tolylcarbonyl, etc., group), an alkoxycarbonyl group (e.g., a methoxycarbonyl, butoxycarbonyl, etc., group), an aryloxycarbonyl group (e.g., a phenoxycarbonyl, tolyloxycarbonyl, etc., group), a sulfo group, an acyloxy group (e.g., an acetoxy, etc., group), a sulfamoyl group (e.g., a methylsulfamoyl, diethylsulfamoyl, phenylsulfamoyl, etc., group), a carbamoyl group (e.g., a carbamoyl, N-octadecylcarbamoyl, N,N-dihexylcarbamoyl, N-methyl-N-phenylcarbamoyl, 3-pentadecylphenylcarbamoyl, etc., group), an acylamino group (e.g., an acetamido, butyramido, benzamido, etc., group), a diacylamino group (e.g., a succinimido, phthalimido, hydantoinyl, etc., group), a ureido group (e.g., an ethylureido, phenylureido, chlorophenylureido, etc., group), a thioureido group (e.g., an ethylthioureido, phenylthioureido, chlorophenylthioureido, etc., group), an alkoxycarbonylamino group (e.g., a methoxycarbonylamino, octoxycarbonylamino, etc., group), an aryloxycarbonylamino group (e.g., a phenoxycarbonylamino, etc., group), an alkoxythiocarbonylamino group (e.g., a methoxythiocarbonylamino, octoxythiocarbonylamino, etc., group), an aryloxythiocarbonylamino group (e.g., a phenoxythiocarbonylamino group, etc.), a sulfonamido group (such as an alkylsulfonamido (e.g., methylsulfonamido, ethylsulfonamido, etc.), arylsulfonamido (e.g., phenylsulfonamido, etc.), etc., group), a heterocyclic group (e.g., a 5- or 6-membered heterocyclic group or condensed heterocyclic group containing at least one hetero atom selected from nitrogen, oxygen and sulfur atoms, such as a furyl, oxazolyl, benzothiazolyl, imidazolyl, etc., group), an arylsulfonyloxy group, (e.g., a phenylsulfonyloxy, tolylsulfonyloxy, etc., group), an alkylsulfonyloxy group (e.g., an ethylsulfonyloxy, dodecylsulfonyloxy, etc., group), an arylsulfonyl group, (e.g., a phenylsulfonyl, tolylsulfonyl, etc., group), an alkylsulfonyl group (e.g., a methylsulfonyl, octylsulfonyl, etc., group), an arylthio group (e.g., phenylthio, tolylthio, etc., group), an alkylthio group, (e.g., a methylthio, octylthio, dodecylthio, etc., group), an alkylsulfinyl group, (e.g., a methylsulfinyl, hexylsulfinyl, etc., group), an arylsulfinyl group, (e.g., a phenylsulfinyl, tolysulfinyl, etc., group), an alkylamino group (e.g., a methylamino, butylamino, etc., group), a dialkylamino group, (e.g., an N,N-diethylamino, N-methyl-N-decylamino, etc., group), an anilino group, an N-alkylanilino group (e.g., an N-methylanilino group, etc.), an N-arylanilino group (e.g., an N-phenylanilino group, etc.), an N-acylanilino group (e.g., a 2-chloro-5-tetra-decanamidoanilino group), etc., a hydroxyl group, and a mercapto group. More preferably W is a phenyl group substituted with an alkyl group, an alkoxy group, or a halogen atom in at least one of the ortho positions because in such case the coupler remaining in the processed photographic film causes less print-out due to the action of heat and light.

Still further, W represents also a heterocyclic group (e.g., a 5-membered or 6-membered heterocyclic group containing a nitrogen atom (for example, a pyridyl, quinolyl or pyrrolyl group, substituted with a substituent as described above for the aryl group for $R_1$), or two or more nitrogen atoms (for example, a pyrazolyl, benzotriazolyl, tetrazolyl, etc., group), an oxygen atom (for example, an unsubstituted or substituted furyl or benzofuranyl group having a substituent as described above for the aryl group for $R_1$); a sulfur atom (for example, an unsubstituted or substituted thienyl or benzo[b]thienyl group having a substituent as described above for the aryl group for $R_1$); and a heterocyclic group containing two or more different hetero-atoms (such as benzoazolyl, benzothiazolyl, and the like).

Moreover, W represents further an acyl group (such as an alkylcarbonyl group (e.g., an acetyl, butyryl, benzoyl, etc., group), a thioacyl group (such as an alkylthiocarbonyl group (e.g., an octylthiocarbonyl, etc., group), an alkylsulfonyl group (e.g., a methylsulfonyl, octylsulfonyl, etc., group), an arylsulfonyl group (e.g., a phenylsulfonyl, tolylsulfonyl, etc., group)), an alkylsulfinyl group (e.g., a methylsulfinyl, hexylsulfinyl, etc., group), an arylsulfinyl group, (e.g., a phenylsulfinyl, tolylsulfinyl, etc., group), a carbamoyl group (such as an alkylcarbamoyl, dialkylcarbamoyl, arylcarbamoyl, etc., (e.g., N-ethylcarbamoyl, N-methyl-N-decylcarbamoyl, phenylcarbamoyl, etc.), group) or a thiocarbamoyl group (such as an alkylthiocarbamoyl (e.g., ethylthiocarbamoyl, etc.), dialkylthiocarbamoyl (e.g., N-methyl-N-decylthiocarbamoyl, etc.), arylthiocarbamoyl (e.g., phenylthiocarbamoyl, etc.), etc., group).

In the above-described formulae, X represents a hydrogen atom, or has up to 40, preferably up to 22, carbon atoms. Suitable examples of groups for X include an alkyl group, an alkenyl group, a cycloalkyl group, an aralkyl group, or a cycloalkenyl group as defined for W, and these groups may be substituted with one or more substituents as illustrated above in regard to these groups of W.

Furthermore, X represents also an aryl group as defined for W or a heterocyclic group as defined for W, each of which may also have one or more of the substituents as illustrated above for W.

Still further, X represents an alkoxycarbonyl group (e.g., a methoxycarbonyl, ethoxycarbonyl, stearyloxycarbonyl, etc. group), an aryloxycarbonyl group (e.g., a phenoxycarbonyl $\alpha$-naphthoxycarbonyl, $\beta$-naphthoxycarbonyl, etc. group), an aralkoxycarbonyl group (e.g., a benzyloxycarbonyl etc., group), an alkoxy group (e.g., a methoxy, ethoxy, decyloxy, etc., group), an aryloxy group (e.g., a phenoxy, tolyloxy, etc., group), an alkylthio group (e.g., an ethylthio, dodecylthio, etc., group), an arylthio group (e.g., a phenylthio, $\alpha$-naphthylthio, etc., group), a carboxyl group, an acylamino group (e.g., an acetamido, 3-[(2,4-di-tert-amylphenoxy)acetamido]benzamido, etc., group), a diacylamino group (e.g., a phthalimido, 3-heptadecylsuccinimido, etc., group), an N-alkylacylamino group (e.g., a N-methylpropionamido, etc. group), an N-arylacylamino group (e.g., a N-phenylacetamido, etc., group), a ureido group (such as a ureido group, N-arylureido (e.g., N-phenylureido, etc.), N-alkylureido (e.g., an N-ethylureido group, etc.), etc., group), a thioureido group (such as a thioureido, N-arylthioureido (e.g., N-phenylthioureido, etc.), N-alkylthioureido (e.g., N-ethylthioureido, etc.), etc. group), an alkoxycarbonylamino group, (e.g., a methoxycarbonylamino, octoxycarbonylamino, etc., group), an aryloxycarbonylamino group (e.g., a phenoxycarbonylamino group, etc.), an alkoxythiocarbonylamino group (e.g., a methoxythiocarbonylamino, octoxythiocarbonylamino, etc., group), an aryloxythiocarbonylamino group (e.g., a phenoxythiocarbonylamino, etc., group), an anilino group (e.g., an N-phenylamino group, 2-chloro-5-tetradecanamidonailino, etc.), an N-alkylanilino group (e.g., an N-methylanilino, etc. group), an N-arylanilino group (e.g., N-phenylanilino, etc., group), an N-acylanilino group (e.g., N-ethyl-(2-chloro-5-tetradecanamido)anilino group), an N-alkylamino group (e.g., an N-butylamino, N-methylamino, etc.), group, an N,N-dialkylamino group (e.g., an N,N-dibutylamino, etc., group), an N-cycloalkylamino group (e.g., an N-cyclohexylamino, etc., group), a cycloamino group (e.g., a piperidino, pyrrolidino, etc., group), an alkylcarbonyl group (e.g., a methylcarbonyl, etc., group), an arylcarbonyl group (e.g., a phenylcarbonyl, etc., group), a sulfonamido group (such as an alkylsulfonamido (e.g., methylsulfonamido, etc.), arylsulfonamido (e.g., phenylsulfonamido, etc.), etc. group) a carbamoyl group (such as an N-alkylcarbamoyl group (e.g., N-methylcarbamoyl, N-{3-[(2,4-di-tert-amylphenoxy)acetamido]propyl}carbamoyl, etc.), N,N-dialkylcarbamoyl (e.g., N-methyl-N-octadecylcarbamoyl, etc.), N-alkyl-N-arylcarbamoyl (e.g., an N-methyl-N-phenylcarbamoyl, etc.), N,N-diarylcarbamoyl (e.g., N,N-diphenylcarbamoyl, etc.), etc., group), a sulfamoyl group (such as an N-alkylsulfamoyl (e.g., N-methylsulfamoyl, N-{3-[(2,4-di-tert-amylphenoxy)accetamido]propyl}sulfamoyl, etc.), N,N-dialkylsulfamoyl (e.g., N-methyl-N-octadecylsulfamoyl, etc.), N-arylsulfamoyl group (e.g., N-phenylsulfamoyl, etc.), N-alkyl-N-arylsulfamoyl (e.g., N-methyl-N-phenylsulfamoyl, etc.), N,N-diarylsulfamoyl (e.g., N,N-diphenylsulfamoyl, etc.), etc., group, a guanidino group (such as an N-alkylguanidino (e.g., N-methylguanidino, etc.), N-arylguanidino (e.g., N-phenylguanidino, etc.), etc., group), a cyano group, an acyloxy group (e.g., a tetradecanoyloxy, etc., group), a sulfonyloxy group (e.g., a benzenesulfonyloxy, etc., group), a hydroxyl group, a mercapto group, a halogen atom (e.g., a chlorine, bromine, fluorine, etc., atom), or a sulfo group.

In the above-described formulae, T represents a hydrogen atom, or has up to 40, preferably up to 22, carbon atoms. Suitable examples of groups for T include a straight chain or branched chain alkyl group, an alkenyl group, a cycloalkyl group, an aralkyl group, or a cycloalkenyl group as defined for W, in which the groups may have one or more substituents as illustrated above in regard to these groups of W.

Furthermore, T represents also an aryl group or a heterocyclic group, each as defined for W, in which each of these groups may have one or more substituents as described above in regard to W.

Still further, T represents a cyano group, an alkoxy group (e.g., a methoxy, butoxy, octyloxy, etc., group), an aryloxy group (e.g., a phenoxy, tolyloxy, naphthoxy, etc., group), a halogen atom (e.g., a chlorine, bromine, fluorine, etc., atom), a carboxyl group, an alkoxycarbonyl group (e.g., a methoxycarbonyl, butoxycarbonyl, etc., group), an aryloxycarbonyl group, (e.g., a phenoxycarbonyl, tolyloxycarbonyl, etc., group), an acyloxy group (e.g., an acetoxy, etc., group), an alkylcarbonyl group (e.g., a methylcarbonyl, octylcarbonyl, etc., group), an arylcarbonyl group (e.g., a phenylcarbonyl tolycarbonyl, etc., group), a thioacyl group (such as an alkylthiocarbonyl group (e.g., an ethylthiocarbonyl, etc., group) an arylthiocarbonyl group (e.g., a phenylthiocarbonyl, etc., group), a sulfo group, a sulfamoyl group (e.g., a methylsulfamoyl, diethylsulfamoyl, phenylsulfamoyl, etc., group), a carbamoyl group (such as an alkylcarbamoyl, dialkylcarbamoyl, arylcarbamoyl, etc., group, (e.g., N-ethylcarbamoyl, N-methyl-N-decylcarbamoyl, N-phenylcarbamoyl, etc., group), an acylamino group (e.g., an acetamido, butyramido, benzamido, etc., group), a diacylamino group (e.g., a phthalimido, 3-heptadecylsuccinimido, etc., group), a ureido group (e.g., an ethylureido, phenylureido, chlorophenylureido, etc., group), a thioureido group (e.g., an ethylthioureido, phenylthioureido, chlorophenylthioureido, etc., group), an alkoxycarbonylamino group (e.g., a methoxycarbonylamino, octoxycarbonylamino, etc., group), an aryloxycarbonylamino group (e.g., a phenoxycarbonylimino, etc., group), an alkoxythiocarbonylamino group (e.g., a methoxythiocarbonylamino, octoxythiocarbonylamino, etc., group), an aryloxythiocarbonylamino group (e.g., a phenoxythiocarbonylamino, etc., group), a sulfonamido group (such as an alkylsulfonamido (e.g., methylsulfonamido, ethylsulfonamido, etc.), arylsulfonamido (e.g., phenylsulfonamido, etc.), etc., group), an alkylsulfonyloxy group (e.g., an ethylsulfonyloxy, dodecylsulfonyloxy, etc., group), an arylsulfonyloxy group (e.g., a phenylsulfonyloxy, tolylsulfonyloxy, etc., group), an arylsulfonyl group (e.g., a phenylsulfonyl, tolylsulfonyl, etc., group), an alkylsulfonyl group (e.g., a methylsulfonyl, octylsulfonyl, etc., group), an arylthio group (e.g., a phenylthio, tolylthio, etc., group), an alkylthio group (e.g., a methylthio, octylthio, dodecylthio, etc., group), an alkylsulfinyl group (e.g., a methylsulfinyl, hexylsulfinyl, etc., group), an arylsulfinyl group (e.g., a phenylsulfinyl, tolylsulfinyl, etc., group), an alkylamino group (e.g., a methylamino, butylamino, etc., group), a dialkylamino group (e.g., an N,N-diethylamino, N-methyl-N-decylamino, etc., group), an anilino group, an N-arylanilino group (e.g., an N-phenylanilino, etc., group), an N-alkylanilino group (e.g., an N-methylanilino, etc., group), an N-acylanilino group (e.g., a 2-chloro-5-tetradecanamidoanilino, etc., group), a hydroxyl group, or a mercapto group.

Y represents the non-metallic atoms necessary to form, in combination with Z and the $$-\overset{\overset{\displaystyle O}{\|}}{C}-$$

moiety, a 5-membered ring or a 6-membered ring and the ring can be part of a condensed ring system as earlier described for Y. Examples of Y include an alkylene group (which term includes a substituted alkylene group), an alkenylene group (which term includes a substituted alkenylene group), and a methine group (which term includes a substituted methine group). Examples of such substituted alkylene, alkenylene and methine groups include those substituted with a substituent having up to 40 carbon atoms, preferably up to 22 carbon atoms, suitable substituent groups for the alkylene, alkenylene and methine groups include a straight chain or branched chain alkyl group, an alkenyl group, a cycloalkyl group, an aralkyl group or a cycloalkenyl group; an aryl group, which can be substituted with one or more of the substituents above described for the aryl group of W, a heterocyclic group which can be substituted with one or more of the substituents above described for the heterocyclic group of W; an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an aryloxycarbonylamino group, an alkoxy thiocarbonylamino group, an aryloxythiocarbonylamino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group.

Further, Y can represent an oxygen atom, a sulfur atom, a sulfonyl group, a sulfoxide group, —N= or an imino group (which term includes a substituted imino group). Examples of substituted imino groups include those substituted with a substituent having up to 40 carbon atoms, preferably up to 22 carbon atoms. Suitable examples of substituents for the imino group include a straight chain or branched chain alkyl group, an alkenyl group, a cycloalkyl group, an aralkyl group, or a cycloalkenyl group; an aryl group which can be substituted with one or more of the substituents described above for the aryl group of W; or a heterocyclic group which can be substituted with one or more of the substituents described above for the heterocyclic group of W; an acyl group; a thioacyl group; an alkylsulfonyl group; an arylsulfonyl group; an alkylsulfinyl group; an arylsulfinyl group; a carbamoyl group; or a thiocarbamoyl group.

In the above, any aryl moiety can be monoaryl or diaryl.

Substituents having up to 40 carbon atoms, preferably up to 22 carbon atoms, as set forth are among those listed below, for example, an unsubstituted methine group or a substituted methine group substituted with a substituent having up to 40 carbon atoms, preferably up to 22 carbon atoms, e.g., a straight or branched chain alkyl group (e.g., a methyl, ethyl, isopropyl, tert-butyl, hexyl, octyl, dodecyl, docosyl, etc., group), an alkenyl group (e.g., an allyl, β-vinylethyl, etc. group), a cycloalkyl group (e.g., a cyclohexyl, norbornyl, 7,7-dialkylnorbornyl, 2-pentadecyl-7,7-dialkylnorbornyl, etc., group), an aralkyl group (e.g., a benzyl, β-phenylethyl, etc., group), a cycloalkenyl group (e.g., a cyclopentenyl, cyclohexenyl, etc., group) an aryl group (e.g., a phenyl, tolyl, methoxyphenyl, α or β-naphthyl, etc., group), a heterocyclic group (e.g., a 5-membered or 6-membered heterocyclic group containing a nitrogen atom (for example, a pyridyl, quinolyl or pyrrolyl group, which can be substituted with a substituent as described above for the aryl group), two or more nitrogen atoms (for example, a pyrazolyl, benzotriazolyl, tetrazolyl, etc., group), an oxygen atom (for example, an unsubstituted or substituted furyl or benzofuranyl group having a substituent as described above for the aryl group); a sulfur atom (for example, an unsubstituted or substituted thienyl or benzo[b]-thienyl group having a substituent as described above for the aryl group); and a heterocyclic group containing two or more different hetero-atoms (such as a benzoazolyl, benzothiazolyl, etc. group); an alkoxycarbonyl group (e.g., a methoxycarbonyl, ethoxycarbonyl, butoxycarbonyl, octadecyloxycarbonyl, etc. group), an aryloxycarbonyl group, (e.g., a phenyoxycarbonyl, α- or β-naphthoxycarbonyl, tolyloxycarbonyl, etc. group), an aralkyloxycarbonyl group (e.g., a benzyloxycarbonyl, etc. group), an alkoxy group (e.g., a methoxy, butoxy, octyloxy, decylosy, etc. group), an aryloxy group (e.g., a phenoxy, tolyloxy, naphthoxy, etc. group), an alkylthio groups (e.g., a methylthio, etc., group), an arylthio groups (e.g., a phenylthio, tolylthio, etc. group), a carboxy group, an acylamino group (e.g., an acetamido, butyramido, benzamido, 3-[(2,4-di-tert-amylphenoxy)acetamido]benzamido, etc., group), a diacylamino group (e.g., a phthalimido, 3-heptadecylsuccinimido, hydantoinyl, etc. group), an N-alkylacylamino group (e.g., an N-methylpropionamido, etc. group), an N-arylacylamino group (e.g., a N-phenylacetamido, etc. group), a ureido group (e.g., a ureido, ethylureido, phenylureido, chlorophenylureido, etc. group), a thioureido group (e.g., an ethylthioureido, phenylthioureido, chlorophenylthioureido, etc. group), an alkoxycarbonylamino group (e.g., a methoxycarbonylamino, octoxycarbonylamino, etc. group), an aryloxycarbonylamino group (e.g., a phenoxycarbonylamino, tolyloxycarbonylamino, etc. group), an alkoxy(thiocarbonyl)amino group (e.g., a methoxy(thiocarbonyl-)amino, octoxy(thiocarbonyl)amino, etc. group), an aryloxy(thiocarbonyl)amino (e.g., a phenoxy(thiocarbonyl)amino, tolyloxy(thiocarbonyl)amino, etc. group), an anilino group, an alkylamino group (e.g., an N-butylamino, N-methylamino, an N,N-dibutylamino, N,N-diethylamino, N-methyl-N-decylamino, etc. group), a cycloamino group (e.g., a piperidino, pyrrolidino, etc. group), an alkylcarbonyl group (e.g., an acetyl, butyryl, benzoyl, etc. group), an arylcarbonyl group (e.g., a phenylcarbonyl, tolylcarbonyl, etc. group), a sulfonamido group (such as an alkylsulfonamido (e.g., methylsulfonamido, etc.), arylsulfonamido (e.g., phenylsulfonamido, etc.), etc., group, a carbamoyl group (such as an N-alkylcarbamoyl group (e.g., N-methylcarbamoyl, N-{3-[2,4-di-tert-amylphenoxy)acetamido]benzyl}carbamoyl, etc.), N,N-dialkylcarbamoyl (e.g., N-methyl-N-octadecylcarbamoyl, etc.), N-alkyl-N-arylcarbamoyl (e.g., an N-methyl-N-phenylcarbamoyl, etc.), etc., group), a sulfamoyl group (such as an N-alkylsulfamoyl (e.g., N-methylsulfamoyl, N-{3-[(2,4-di-tert-amylphenoxy)acetamido]benzyl}sulfamoyl, etc.,), N,N-dialkylsulfamoyl (e.g., N-methyl-N-octadecylsulfamoyl, etc.), N-arylsulfamoyl group (e.g., N-phenylsulfamoyl, etc.), N-alkyl-N-arylsulfamoyl (e.g., N-methyl-N-phenylsulfamoyl, etc.), N,N-diarylsulfamoyl (e.g., N,N-diphenylsulfamoyl, etc.), etc., group), a cyano group, an acyloxy group (e.g., an acetoxy, tetradecanoyloxy, etc., group) a sulfonyloxy group (such as an arylsulfonyloxy (e.g., a phenylsulfonyloxy, tolylsulfonyloxy, etc.) alkylsulfonyloxy (e.g., ethylsulfonyloxy, dodecylsulfonyloxy, etc., group), a halogen atom (e.g., a chlorine, bromine, fluorine, etc., atom) or a sulfo group.

Z represents a sulfoxide group, a methylene group (which term includes a substituted methylene group substituted with a substituent as described for the substituted alkylene for Y), —N=, an imino group (which term includes a substituted imino group substituted with a substituent as described for in the substituted imino group for Y), an oxygen atom, a sulfur atom or a methine group (which term includes a substituted methine group substituted with a substituent as described for the substituted methine group for Y).

$Z_1$ and $Z_2$, which may be the same or different, each represents a methine group (which term includes a substituted methine group substituted with a substituent as described for the substituted methine group for Y) or —N=. The nitrogen containing ring containing $Z_1$ and $Z_2$ can be part of a condensed ring system as earlier described for $Z_1$ and $Z_2$ in formula (III).

Q represents an oxygen atom or an imino group.

$Y_1$ represents an ethylene group (which term includes a substituted ethylene group), a methylene group (which term includes a substituted methylene group, or an alkenylene group (which term includes a substituted alkenylene group). These substituted groups can be substituted with one or more of the substituents as described for the substituted alkylene group or the substituted alkenylene group for Y, an oxygen atom, a sulfur atom or an imino group (which term includes a substituted imino group substituted with a substituent as described for the substituted imino group for Y).

Particularly preferred examples of groups for the

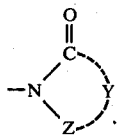

moiety are, for example, 2-oxo-1,3-oxazolidin-3-yl, 2-oxo-1-pyrrolidino, 2-oxoimidazolidin-1-yl, 2-oxo-1,2-dihydro-1-pyridyl, 2-oxo-1-morpholino, 3-indazolon-2-yl, 1,2,3,4-tetrahydro-1,4-dioxo-2-phthalazinyl, 1,2-dihydro-1-oxo-2-phthalazinyl, 2-phthalimidinyl, 1,2-dihydro-2-oxo-2-quinolyl, 2-oxo-1,3-thiazolidin-3-yl, 2,3-dihydro-2-oxo-1,3-benzothiazol-3-yl, 2-oxo-1-piperidyl, 2-oxobenzimidazolin-1-yl, 1-methyl-3-indazolon-2-yl, 2-oxo-4-chloro-1,2-dihydro-1-pyridyl, 1,2,3,4-tetrahydro-1-oxo-2-phthalazinyl, 3,4-dihydro-4-oxopyrimidin-3-yl, 2-oxo-4-phenyl-1-piperazinyl, s-triazolo-[4,3-b]-3-oxo-pyridazin-2-yl, 3-phenyl-4-oxo-1,2,5-oxadiazol-5-yl, 3-oxo-s-triazolo-[3,4-a]-isoquinol-2-yl, and the like.

Particularly preferred groups for the

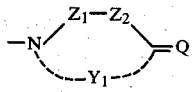

moiety are, for example 4-oxo-1,4-dihydro-1-pyridyl, 1,4-dihydro-4-imino-1-pyridyl, 3-indazolon-1-yl, 3,5-dimethyl-4-oxo-1,4-dihydro-1-pyridyl, 4-oxo-1,4-dihydro-1-quinolyl, and the like.

The couplers represented by the general formulae (IV), (V), (VI) or (VII) of the present invention can combine directly at W, X, T, Y, $Y_1$ or Z to each other or through a divalent group derived from W, X, T, Y, $Y_1$ or Z to form a symmetrical or asymmetrical complex coupler, e.g., to yield compounds represented by the general formulae Cp-X-Cp, Cp-W-Cp, Cp-T-Cp, Cp-Y-Cp, Cp-$Y_1$-Cp or Cp-Z-Cp, where Cp is the residue of a magenta color image-forming coupler.

The magenta coupler used in the present invention exhibits various properties depending on the substituents W, X, T, Y, $Y_1$ and Z, and this feature is applicable to various photographic objects. When at least one of W, X, T, Y, $Y_1$ and Z contains a hydrophobic group of 8 or more carbon atoms, the coupler associates with a hydrophilic colloid and becomes non-diffusible in the hydrophilic colloid layer of a light-sensitive material. Such a coupler can be incorporated into a silver halide emulsion layer. When Y, $Y_1$ or Z contains a diffusion-resistant hydrophobic group and at least one of W, X and T contains a water-solubilizing group, such as a sulfo group or a carboxy group, the coupler per se in non-diffusible but can provide a diffusible dye by the oxidizing coupling reaction with an aromatic primary amine developing agent. Such a diffusible dye-providing coupler is suitable for use in diffusion transfer color photography.

The process of forming a dye image by the oxidizing coupling reaction with an aromatic primary amine developing agent can be classified mainly into two-types depending on the method of adding the coupler. In one type, the so-called "coupler-in-the-emulsion type", the coupler is incorporated in an emulsion during the production of the light-sensitive material. In the other type, the so-called "coupler-in-the-developer type", the coupler is dissolved in a developer solution and provided in the emulsion layer through diffusion during development.

The coupler used in the "coupler-in-the-emulsion type must" be fixed in an emulsion layer, that is, must be diffusion-resistant. If the coupler is not diffusion-resistant, the coupler migrates in the light-sensitive material and the dye is formed in the wrong light-sensitive emulsion layer, thus markedly deteriorating the color reproduction capability of the light-sensitive material.

In order to render a coupler diffusion-resistant, a group containing a hydrophobic residue of 8 to 32 carbon atoms is introduced into the coupler molecule. This residue is generally called a "ballast group". The ballast group can be combined with the coupler skeleton directly or through an imino bond, an ether bond, a carbonamido bond, a sulfonamino bond, an ureido bond, an ester bond, an imido bond, a carbamoyl bond, a sulfamoyl bond, and the like.

Some examples of ballast groups are shown in the specific examples of the couplers according to the present invention set forth hereinafter.

Examples of suitable ballast groups are an alkyl group, an alkoxyalkyl group, an alkenyl group, an aryl group substituted with an alkyl group, an aryl group substituted with an alkoxy group, a terphenyl group, and the like. These ballast groups can be substituted with a halogen atom such as fluorine, chlorine, etc., a nitro group, a cyano group, an alkoxycarbonyl group, an amido group, a carbamoyl group, a sulfonamido group, and the like.

Classes of ballast groups are illustrated below:

(I) Alkyl groups and alkenyl groups:

For instance, $-CH_2-CH(C_2H_5)H_2$, $-C_{12}H_{25}$, $-C_{16}H_{33}$, $-C_{17}H_{35}$, etc.

(II) Alkoxyalkyl groups:

For instance,

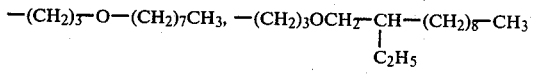

etc., as described in Japanese Patent Publication No. 27563/1964.

(III) Alkylaryl groups:

For instance,

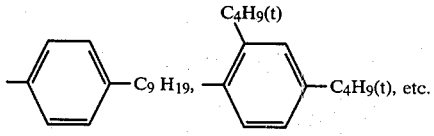

(IV) Alkylaryloxyalkyl groups:

For instance,

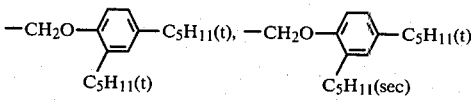

-continued

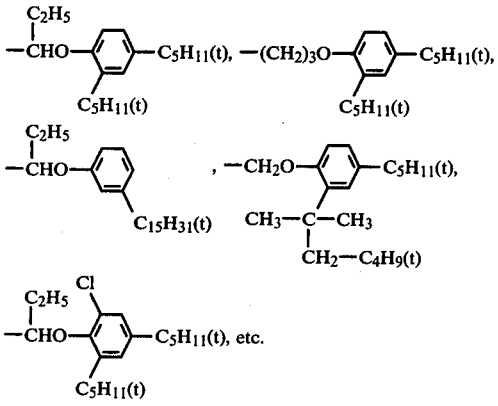

(V) Acylamidoalkyl groups:
For instance,

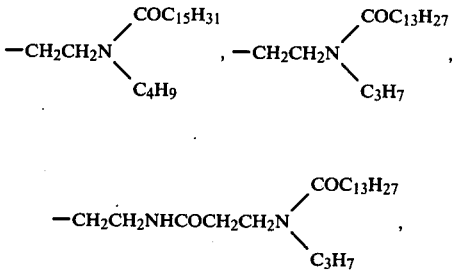

etc., as described in U.S. Pat. Nos. 3,337,344 and 3,418,129.

(VI) Alkoxyaryl groups and aryloxyaryl groups:
For instance,

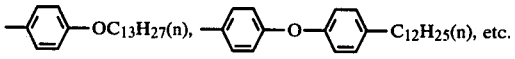

(VII). Residues having a long chain alkyl or alkenyl aliphatic group and also a carboxyl or sulfo water-solubilizing group:
For instance,

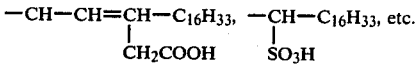

(VIII) Alkyl groups substituted with an ester group:
For instance,

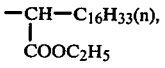

$-CH_2-CH_2-COOC_{12}H_{25}(n)$, etc.

(IX) Alkyl groups substituted with an aryl group or a heterocyclic group: For instance,

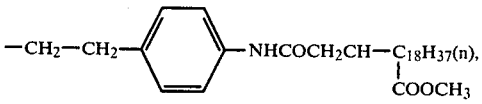

-continued

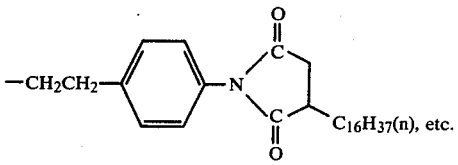

(X) Aryl groups substituted with an aryloxyalkoxycarbonyl group:
For instance,

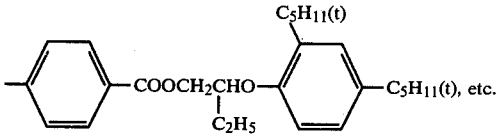

Specific examples of preferred ballast groups are n-octyl, 2-ethylhexyl, tert-octyl, n-nonyl, n-decyl, n-dodecyl, 1,1-dimethyldecyl, 2,2-dimethyldecyl, n-octadecyl, 2-(n-hexyl)decyl, n-octadecyl, 9,10-dichlorooctadecyl, heptyloxyethyl, 2,4-di-tert-amylcyclohexyl, dodecyloxypropyl, oleyl, 2,4-di-tert-butylphenyl, 2,4-di-tert-amylphenyl, 2,4-di-tert-amyl-6-chlorophenyl, 3-n-pentadecylphenyl, 2-dodecyloxyphenyl, 3-heptadecyloxyphenyl, o-terphenyl, perfluoroheptyl, and the like.

Specific examples of the couplers according to the present invention are set forth below, but the present invention is not to be construed as being limited to only these couplers.

Coupler (1)

1-(2,4,6-Trichlorophenyl)-3-[3-(2,4-di-tert-amylphenoxyacetamido)benzamido]-4-(2-oxo-1,3-oxazolidin-3-yl)-5-oxo-2-pyrazoline Coupler (2)

1-(2,4,6-Trichlorophenyl)-3-methoxy-4-(2-oxo-1,3-oxazolidin-3-yl)-5-oxo-2-pyrazoline Coupler (3)

1-(2,4,6-Trichlorophenyl)-3-(2-chloro-5-tetradecanamido)anilino-4-(2-oxo-1-pyrrolidino)-5-oxo-2-pyrazoline Coupler (4)

1-(2,4,6-Trichlorophenyl)-3-{3Z-[α-(2,4-di-tert-amylphenoxy)butyramido]anilino}-4-(2-oxoimidazolidin-1-yl)-5-oxo-2-pyrazoline Coupler (5)

1-Benzyl-3-(2-chloro-5-tetradecanamido)anilino-4-(2-oxo-1,2-dihydro-1-pyridyl)-5-oxo-2-pyrazoline Coupler (6)

1-(2,4,6-Trichlorophenyl)-3-{3-[α-(3-pentadecylphenoxy)butyramido]benzamido}-4-(2-oxo-1-morpholino)-5-oxo-2-pyrazoline Coupler (7)

1-(2,6-Dichloro-4-methoxyphenyl)-3-{2-chloro-5-[α-(2,4-di-tert-amylphenoxy)butyramido]anilino}-4-(3-indazolon-2-yl)-5-oxo-2-pyrazoline Coupler (8)

1-Phenyl-3-methyl-4-(1,2,3,4-tetrahydro-1,4-dioxo-2-phthalazinyl)-5-oxo-2-pyrazoline Coupler (9)

1-(2,4,6-Trichlorophenyl)-3-{3-[(2,4-di-tert-amylphenoxy)acetamido]benzamido}-4-(1,2-dihydro-1-oxo-2-phthalazinyl)-5-oxo-2-pyrazoline Coupler (10)

1-[2,6-Dichloro-4-(2,4-di-tert-amylphenoxyacetamido)phenyl]-3-ethoxy-4-(2-phthalimidinyl)-5-oxo-2-pyrazoline Coupler (11)

1-(2,4,6-Trichlorophenyl)-3-(2-methoxy-5-tetradecyloxycarbonyl)anilino-4-(4-oxo-1,3-thiazolidin-3-yl)-5-oxo-2-pyrazoline Coupler (12)

1-Benzyl-3-(2-chloro-5-tetradecanamido)anilino-4-(1,2-dihydro-oxo-2-isoquinolyl)-5-oxo-2-pyrazoline Coupler (13)

1-(2,4,6-Trichlorophenyl)-3-{3-[α-(2,4,-di-tert-amylphenoxy)butyramido]benzamido}-4-(2-oxo-1,3-thiazolidin-3-yl)-5-oxo-2-pyrazoline Coupler (14)

1-{4-[α-(2,4-Di-tert-amylphenoxy)butyramido]phenyl-3-(2,4-dichloroanilino)}-4-(2,3-dihydro-2-oxo-1,3-benzothioazol-3-yl)-5-oxo-2-pyrazoline Coupler (15)

2-Heptadecyl-3H-3-(2-oxo-1,3-oxazolidin-3-yl)pyrazolo[1,5-a]-benzimidazole

Coupler (16)

1-(2,4,6-Trichlorophenyl)-3-{3-[α-(2,4-di-tert-amylphenoxy)butyramido]benzamido}-4-(4-oxo-1,4-dihydro-1-pyridyl)-5-oxo-2-pyrazoline Coupler (17)

1-(2,4,6-Trichlorophenyl)-3-[α-(2,4-di-tert-amylphenoxy)butyramido]-4-(4-imino-1,4-dihydro-1-pyridyl)-5-oxo-2-pyrazoline Coupler (18)

1-(2,4,6-Trichlorophenyl)-3-{2-chloro-5-[α-(3-pentadecylphenoxy)butyramido]anilino}-4-(3-methyl-4-oxo-1,4-dihydro-1-pyridyl)-5-oxo-2-pyrazoline Coupler (19)

1-(2,6-Dichloro-4-methoxyphenyl)-3-[α-(3-pentadecylphenoxy)butyramido]-4-(4-oxo-1,4-dihydro-1-pyridyl)-5-oxo-2-pyrazoline Coupler (20)

2-(2-Methoxy-5-tetradecyloxycarbonylanilino)-3-(4-oxo-1,4-dihydro-1-pyridyl)-3H-pyrazolo[1,5-a]benzimidazole Coupler (21)

1-(2,4,6-Trichlorophenyl)-3-[(2-chloro-5-octadecylsulfamoyl)anilino]-4-(1,2,3,4-tetrahydro-1-oxo-2-phthalazinyl)-5-oxo-2-pyrazoline Coupler (22)

1-Benzyl-3-[(3-tetradecanamido-4-methoxy)anilino]-4-(3-phenyl-4-oxo-4,5-dihydro-1,2,5-oxadiazoyl-5-yl)-5-oxo-2-pyrazoline Coupler (23)

1-(2,4,6-Trichlorophenyl)-3-{2-chloro-3-[α-(2,4-di-tert-amylphenoxy)butyramido]anilino}-4-(1-acetyl-3-indazolon-2-yl)-5-oxo-2-pyrazoline The magenta coupler represented by the general formula (II) of the present invention can be generally prepared by the method set forth below.

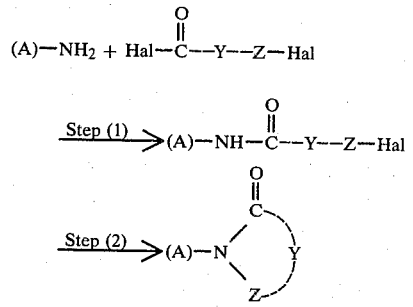

wherein (A), Y and Z each has the same meaning as defined in general formula (II), Hal represents a halogen atom such as a chlorine atom, and $—NH_2$ represents an amino group attached at the coupling position of the coupler.

In Step (1), a magenta coupler having an amino group at the coupling position is reacted with an acid halide using a method as described in Japanese Patent Applications 66378/1974, 72994/1974 and 73673/1974. In Step (2), the product obtained in Step (1) is subjected to a dehydrohalogenation and cyclization to prepare the desired cyclic product. The ring-closure reaction can be carried out using any solvent which is inert to the halo compound obtained in Step (1). Preferred solvents include protic polar solvents, for example, carboxylic acid solvents (such as acetic acid, propionic acid, etc.), alcohol solvents (such as methanol, ethanol, etc.); aprotic solvents, for example, halogenated hydrocarbon solvents (such as methylene chloride, chloroform, etc.), benzene, pyridine, etc.; and aprotic polar solvents such as dimethylformamide, hexamethylphosphotriamide, etc. An alkali metal hydroxide (such as sodium hydroxide, potassium hydroxide, etc.), sodium hydride, an alkali metal alkoxide (such as sodium methoxide, sodium ethoxide, etc.), and the like can be used as a catalyst. The use of an alkali metal alkoxide e.g., sodium alkoxide in an alcohol solvent such as methanol, ethanol, isopropanol, etc., is particular preferred. The reaction can be carried out at a temperature ranging from about 0° to 150° C. depending on the other reaction conditions. A temperature range of 0° to 45° C. is preferred.

The magenta coupler represented by the general formula (III) can be prepared by the method set forth below.

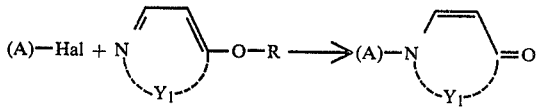

wherein (A) and $Y_1$ each has the same meaning as defined in general formula (III), Hal represents a halogen atom such as a chlorine atom, and R represents a lower alkyl group having 1 to 6 carbon atoms. (A)-Hal is a compound in which one of the hydrogen atoms at the coupling position of a magenta coupler, (A), is substituted with a halogen atom and can be prepared by the method described in U.S. Pat. Nos. 3,006,759 and 3,522,051. Also, in the case of a 5-pyrazolone having an anilino group at the 3-position, the hydrogen atom of the NH group at the 3-position is initially substituted with an alkoxycarbonyl group and then the product is halogenated to prepare a compound which can be used as the above described (A)-Hal compound. The reaction of the (A)-Hal compound with the

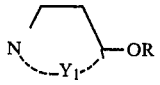

compound, in which an alcohol is liberated, can be carried out at a temperature of about 100° to 200° C. in the presence or absence of a solvent to produce the desired compound in high yield. The procedures will be further described in greater detail in the synthesis examples described hereinafter.

Further, the magenta coupler represented by general formulae (II) and (III) can be generally prepared using the method described in Japanese Patent Application No. 7272/1974 as illustrated in the following reaction schematic.

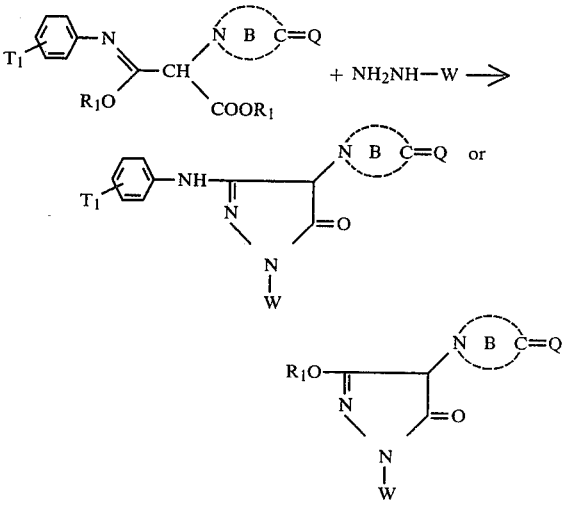

wherein B, Q and W each has the same meaning as defined previously, $T_1$ represents a substituent for T as described above, and $R_1$ represents a lower alkyl group having 1 to 6 carbon atoms or a phenyl group. The ring-closure reaction with a hydrazine, $NH_2NH$-W, described above can be carried out in an alcohol solvent, a carboxylic acid solvent, a hydrocarbon solvent, etc. Also, the reaction can be carried out in high yield in the absence of a solvent by melting the reactions. A weak acid (such as phenol, cresol, acetic acid, etc.) or a strong acid, (such as methanesulfonic acid, p-toluenesulfonic acid, trichloroacetic acid, etc.) can be used as a catalyst. Depending on the reaction conditions, the yields of the 3-anilino-5-pyrazolone and the 3-alkoxy-5-pyrazolone can be varied. The latter can be particularly obtained in high yield when a strong acid is used in excess.

The preparation of the 3-alkyl-5-pyrazolone and the pyrazolo[1,5-a]benzimidazole can be carried out using a known method or a method similar thereto. These methods which can be used to prepare the magenta couplers of the present invention will be further illustrated in greater detail in the following synthesis examples.

Typical synthesis examples of the compounds of the present invention are illustrated below. Unless otherwise indicated herein, all parts, percents, ratios and the like are by weight, and all procedures were conducted at atmospheric pressure, unless otherwise indicated.

SYNTHESIS EXAMPLE 1

Preparation of 1-(2,4,6-Trichlorophenyl)-3-{3-[(2,4-di-tert-amylphenoxy)acetamido]benzamido}-4-(2-oxo-1,3-oxazolidin-3-yl)-5-oxo-2-pyrazoline [Coupler (1)]

95 g of the stannic chloride salt of 1-(2,4,6-Trichlorophenyl)-3-{3-[(2,4-di-tert-amylphenoxy)acetamido]benzamido}-4-amino-5-oxo-2-pyrazoline was dissolved in 300 ml of chloroform and 15 g of β-chlorethylchlorocarbonate was added thereto at 25° C. in a nitrogen gas atmosphere. A solution containing 10 g of triethylamine dissolved in 100 ml of chloroform was gradually added dropwise to the reaction mixture and the mixture was stirred 3 hours. After the completion of the reaction, the chloroform was removed under reduced pressure and 500 ml of ethyl acetate was added to the residue and the mixture was washed with water. The ethyl acetate layer was dried with anhydrous sodium sulfate. The ethyl acetate was removed under reduced pressure and, without crystallization, the residual oily product was dissolved in 300 ml of methanol and 6.5 g of sodium methylate was added thereto at a temperature below 10° C. After stirring for 1 hour at 10° to 20° C., the mixture was then refluxed for 1 hour. The reaction mixture was neutralized with acetic acid, 500 ml of ethyl acetate, was added and the mixture was washed repeatedly with water. The ethyl acetate layer was dried with anhydrous sodium sulfate. The ethyl acetate was removed under reduced pressure and the residue was recrystallized from a solvent mixture of hexane and ethyl acetate (10:1 by volume ratio) to provide 76.4 g of Coupler (1) having a melting point of 122° to 125° C.

| Elemental Analysis | | | |
|---|---|---|---|
| Calculated for $C_{37}H_{40}N_5O_6Cl_3$ (%); | C: 58.7, | H: 5.28, | N: 9.25 |
| Found (%); | C: 58.4, | H: 5.30, | N: 9.41 |

SYNTHESIS EXAMPLE 2

Preparation of 1-(2,4,6-Trichlorophenyl)-3-methoxy-4-(2-oxo-1,3-oxazolidin-3-yl)-5-oxo-2-pyrazoline [Coupler (2)]

6.9 g of 1-(2,4,6-trichlorophenyl)-3-methoxy-4-amino-5-oxo-2-pyrazoline hydrochloride was dissolved in 100 ml of chloroform and 2.9 g of β-chlorethylchlorocarbonate was reacted therewith using the same procedures as described in Synthesis Example 1 to prepare 1-(2,4,6-trichlorophenyl)-3-methoxy-4-(β-chlorethoxycarbonylamino)-5-oxo-2-pyrazoline. The intermediate, without isolation, was subjected to a ring-closure reaction using 1.5 g of sodium methylate using the same procedures as described in Synthesis Example 1. The residue was recrystallized from a solvent mixture of hexane and ethyl acetate (10:1 by volume ratio) to provide 5.4 g of Coupler (2) having a melting point of 200° to 210° C.

| Elemental Analysis | | | |
|---|---|---|---|
| Calculated for $C_{13}H_{10}N_3)_4Cl_3$ (%); | C: 41.2, | H: 2.64, | N: 11.1 |
| Found (%); | C: 41.4, | H: 2.61, | N: 10.9 |

SYNTHESIS EXAMPLE 3

Preparation of 1-Benzyl-3-(2-chloro-5-tetradecanamido)anilino-4-(2-oxo-1,2-dihydro-1-pyridyl)-5-oxo-2-pyrazoline [Coupler (5)]

Step 1: Preparation of Ethyl β-Ethoxy-β-(2-chloro-5-tetradecanamido)-anilino-α-(2-oxo-1,2-dihydro-1-pyridyl)acrylate 11.5 g of ethyl β-ethoxy-β-(2-chloro-5-tetradecanamido)anilino-α-bromoacrylate which was prepared by the method described in U.S. Patent Application Ser. No. 540,771, filed Jan. 14, 1975, was dissolved in 100 ml of dimethylformamide and 5.3 g of the potassium salt of α-pyridone was added thereto and then the mixture was stirred at 25° C. for 5 hours. After the completion of the reaction, 300 ml of ethyl acetate was added to the mixture and the mixture was washed with water. The ethyl acetate layer was dried with anhydrous sodium sulfate and the ethyl acetate was removed under reduced pressure to provide an oily residue.

Step 2: Preparation of Coupler (5)

5.9 g of the oily residue obtained in Step 1 above and 2.4 g of benzylhydrazine were heated at a temperature of 60° to 80° C. for 5 hours in the absence of a solvent under a nitrogen gas atmosphere with stirring. The reaction mixture was dissolved in 100 ml of ethyl acetate and washed several times with water. The ethyl acetate layer was dried with anhydrous sodium sulfate and the ethyl acetate was removed under reduced pressure and the residue crystallized from acetonitrile to provide 3.6 g of Coupler (5) having a melting point of 163° to 168° C.

| Elemental Analysis | | | |
|---|---|---|---|
| Calculated for $C_{35}H_{44}N_5O_3Cl$ (%); | C: 68.0, | H: 7.12, | N: 11.3 |
| Found (%); | C: 67.89, | H: 7.15, | N: 11.2 |

SYNTHESIS EXAMPLE 4

Preparation of 1-(2,4,6-Trichlorophenyl)-3-{3-[α-(2,4-di-tert-amylphenoxy)butyramido]benzamido}-4-(4-oxo-1,4-dihydro-1-pyridyl)-5-oxo-2-pyrazoline [Coupler (16)]

39 g of 1-(2,4,6-trichlorophenyl)-3-{3-[α-(2,4-di-tert-amylphenoxy)butyramido]benzamido}-4-bromo-5-oxo-2-pyrazoline and 12 g of 4-methoxypyridine were suspended in 5 ml of benzene and the mixture was heated at a temperature of 100° to 110° C. for 2 hours with stirring. After the completion of the reaction, 100 ml of ethyl acetate was added to the reaction mixture and the reaction mixture was washed. Solids which were not soluble in ethyl acetate were removed by filtration, washed with water and dried to provide 21 g of Coupler (16) having a melting point of 275° to 285° C.

| Elemental Analysis | | | |
|---|---|---|---|
| Calculated for $C_{41}H_{44}N_5O_5Cl_3$ (%); | C: 62.1, | H: 5.55, | N: 8.83 |
| Found (%); | C: 62.41, | H: 5.48, | N: 8.80 |

The coupler of the present invention can be advantageously used to prepare a coupler dispersion by dissolving the coupler into any of an organic solvent which has a high boiling point (higher than about 170° C.) and is immiscible with water, a low boiling organic solvent and a water-soluble organic solvent or a high boiling water-immiscible organic solvent and/or a low boiling organic solvent and/or a water-soluble organic solvent.

The high boiling water-immiscible organic solvents described in U.S. Pat. No. 2,322,027 can be used as a solvent. Examples of preferred solvents include di-n-butyl phthalate, benzyl phthalate, triphenyl phosphate, tri-o-cresyl phosphate, diphenyl mono-o-chlorophenyl phosphate, monophenyl di-o-chlorolphenyl phosphate, dioctyl phthalate, dibutyl sebacate, acetyl tributyl citrate, tri-tert-octyl trimellitate, n-nonylphenol, dioctyl butyl phosphate, N,N-diethyl laurylamide, 3-pentadecylphenyl ethyl ether, 2,5-di-sec-amylphenyl butyl ether, and the like.

Low boiling (lower than about 170° C.) or water-soluble organic solvents which can be used together with or in place of the high boiling solvent are described in U.S. Pat. Nos. 2,801,171; 2,801,170; 2,949,360; etc. Examples of these organic solvents are as follows:

(1) Organic solvents which have a low boiling point and are substantially insoluble in water such as methyl acetate, ethyl acetate, propyl acetate, butyl acetate, isopropyl acetate, ethyl propionate, secondary butyl alcohol, ethyl formate, butyl formate, nitromethane, nitroethane, carbon tetrachloride, chloroform, and the like.

(2) Water-soluble organic solvents such as methyl isobutyl ketone, β-ethoxyethylacetate, Carbitol acetate (diethyleneglycol monoethyl ether acetate), methoxytriglycol acetate, acetyl acetone, diacetone alcohol, butyl Carbitol, methyl Carbitol, methyl ethyl ketone, methanol, ethanol, acetonitrile, dimethylformamide, dioxane, and the like.

It is desirable for the solvent to have a sufficiently low content (i.e., about 5 wt% or less) of water so as to not adversely affect the solubility of the coupler.

A method for removing the low boiling or water-soluble solvent from a coupler dispersion which comprises air-drying the cooled noodle-like dispersion or washing the cooled noodle-like dispersion continuously with water, such as described in U.S. Pat. No. 2,801,171, can be employed.

For the dispersion of an oil-soluble coupler, an emulsifying homogenizer, a colloid mill, an ultrasonic wave emulsifying apparatus, and the like are suitable. A diffusion resistant coupler having both a ballast group and a carboxylic acid group or a sulfonic acid group in the molecule is soluble in a neutral or weakly alkaline aqueous solution. The coupler can be incorporated in a photographic emulsion by adding such an aqueous solution containing the coupler to the photographic emulsion. The coupler is believed to be diffusion resistant through the formation of micelles in the hydrophilic polymer.

The couplers which are used in the present invention can be clearly distinguished from conventionally known two-equivalent magenta couplers described above in their chemical structures. Further the couplers of the present invention have the features that they have high chemical stabilities and that the synthesis thereof is very easy, as is set forth in the above synthesis examples.

The coupler of the present invention is a two-equivalent coupler which theoretically requires only two equivalents of silver halide, as an oxidizing agent, for forming one molecule of a dye. The required silver halide can be reduced to about half of that used for prior art four-equivalent pyrazolone type couplers, thus not only halving the silver halide contained in a light-sensitive material and reducing the cost of preoduction of the light-sensitive material, but also reducing the light-scattering due to the emulsion grains and improving the sharpness of the image.

The magenta coupler used in the present invention can be converted into an azomethine dye in a high yield by the oxidizing coupling reaction using an exposed silver halide as an oxidizing agent. Some of the four-equivalent couplers used in the prior art have a low conversion yield into the dye, since the leuco dye, produced as an intermediate product, gives rise to side reactions such as azine ring formation. On the contrary, the magenta coupler used in the present invention can be converted into an azomethine dye in a high yield, since the reaction does not proceed through such a reactive intermediate product. Consequently, in the color photographic light-sensitive material according to the present invention, it is possible to reduce the quantity of the magenta forming coupler, to reduce the content of the silver halide and to reduce the thickness of the emulsion layer. Thus, it is easy to reduce the cost of the light-sensitive material, to improve the sharpness of the light-sensitive material, and to promote the development of the light-sensitive material.

The magenta coupler used in the present invention has a strong coupling activity for an oxidized aromatic primary amine color developing agent and rapidly removes the oxidized product of the developing agent formed during color development, so that the development of the silver halide emulsion is accelerated.

In the magenta coupler used in the present invention, the process of forming a dye is completed in a color developing bath and it is not necessary thereafter to use a bleaching bath containing a strong oxidizing agent such as potassium ferricyanide or potassium dichromate. Thus, a treatment with a blixing bath containing a silver complex salt forming agent and a weak oxidizing agent such as a ferric chelate of ethylenediaminetetraacetic acid (EDTA) or a bleaching bath contining a ferric salt (for example, ferric chloride) is possible and, consequently, it is easy to shorten the overall time for the color processings as well as to solve the problem of environmental pollution in waste processing solution discharge.

The magenta coupler used in the present invention in which the coupling position is substituted is inactivated by carbonyl compounds such as aldehydes and ketones to a lessened extent, while the coupling position-unsubstituted magenta coupler used in the prior art, in particular, in an emulsion layer, is changed into a compound with low color forming reactivity, such as a methylol or methelene-bis-compound, by formaldehyde in the air, which often does not provide sulfficient color formation during color development. One feature of the color photographic light-sensitive material according to the present invention is that the material is hardly influenced by such chemicals.

The coupling-position-substituted magenta coupler used in the present invention has the advantages when used for conventional color photographic light-sensitive materials, as described in the Examples set forth hereinafter, that the stability in an emulsion layer with the passage of time is high and, in particular, the color formation is reduced to a lesser extent, even with the passage of time at low temperature or under high humidity, as compared with the above described known couplers. In a color photographic light-sensitive material, the retention on storage of the characteristics of a fresh film is one of the most important factors in the assessment of the characteristics thereof. Moreover, it has been found that a color developed dye image formed from the magenta coupler of the present invention has superior heat resistance to one formed from coupling-position-unsubstituted couplers and, even in comparison with the foregoing known couplers having a substituent in the 4-position of the same pyrazolone nucleus, the coupler of the present invention has a higher heat resistance.

The coupler in accordance with the present invention can be used for a color photographic light-sensitive material containing a small amount of silver halide, for example, from one tenth to one hundredth as much as that in conventional color photographic light-sensitive materials. The color photographic light-sensitive material containing silver halide in such a small amount can provide sufficiently high color density by a method in which developed silver formed by color development is halogenation-bleached and then color developed again to increase the amount of dye formed, as described, for example, in U.S. Pat. Nos. 2,623,822, 2,814,565, etc., or a color intensification method using a peroxide or a cobalt complex salt is employed to increase the amount of dye formed, as described, for example, in German Patent Application No. (OLS) 2,357,694, U.S. Pat. Nos. 3,674,490 and 3,761,265, German Patent Applications (OLS) Nos. 2,044,833, 2,056,359, 2,056,360 and 2,226,770, Japanese Patent Applications Nos. (OPI) 9728/1973 and 9729/1973, etc.

The two-equivalent magenta coupler of this invention can be used together with other magenta couplers in which the amount of these other magenta couplers employed with the two equivalent magenta couplers of the invention, in general, ranges from about 5 to 80 mole% based on the total amount of the magenta couplers employed, as described in, for instance, U.S. Pat. Nos. 2,439,089, 2,369,489, 2,600,788, 3,558,319, 2,311,081, 3,419,391, 3,214,437, 3,006,759, 2,725,292, 3,408,194, 2,908,573, 3,519,429, 3,615,506, 3,432,521, 3,152,896, 3,062,653, 3,582,322, 2,801,171, 3,311,476, British Pat. No. 956,261, Japanese Patent Publication Nos. 2016/1969 and 19032/1971; Japanese Patent Application Nos. 114445/1972; 56050/1973; 34971/1973; 21454/1973; 108798/1973; and 114446/1972, with magenta-colored couplers incorporated in an amount from about 2 to 20 mole% based on the total amount of the magenta couplers employed, as described in U.S. Pat. Nos. 2,983,608; 2,455,170; 2,725,292; 3,005,712; 3,519,429; and 2,688,539; British Pat. Nos. 800,262 and 1,044,778, and Belgian Pat. No. 676,691, with the so called development inhibitor releasing type couplers capable of imagewise releasing development inhibiting compounds at development, generally incorporated in an amount from about 2 to 20 mole% based on the total amount of the magenta couplers employed, such as, for instance, the monothio type couplers as described in U.S. Pat. Nos. 3,227,550 and 3,227,554 and British Pat. No. 953,454, the o-aminophenylazo type couplers as described in U.S. Pat. No. 3,148,062, and the couplers as described in Japanese Patent Publication No. 8750/1972 and German Patent Application (OLS) No. 2,163,811, and also with the hydroquinone releasing development inhibiting compounds which can be employed therewith in an amount from about 2 to 20 mole% based on the total amount of the magenta couplers employed, as described in U.S. Pat. No. 3,297,445 and British Pat. No. 1,058,606.

Two or more of the above described compounds such as magenta couplers and the like can be incorporated in the same layer or the same compound can be incorporated in two or more layers, in order to achieve the charactristics required in the photographic light-sensitive material.

In general, the coupler of the present invention can be coated on a support in a range of from about $1\times10^{-4}$ to $5\times10^{-3}$ mole/m$^2$, preferably $3\times10^{-4}$ to $2\times10^{-3}$ mole/m$^2$.

The coupler of the present invention can be also used in a developer solution. In such case a suitable amount of the coupler ranges from about 0.2 to 50 g, preferably 0.5 to 10 g, per liter of the developer solution.

The coupler of the present invention is advantageously used in combination with a green-sensitive silver halide emulsion.

For the purpose of improving the fastness to light of the magenta dye formed in an emulsion layer or thereto, or preventing yellowing or print-out of the coupler remaining in an unexposed portion or color stain, the photographic light-sensitive material used in the present invention advantageously contains a p-substituted phenol derivative. Particularly suitable p-substituted phenol derivatives can be selected from one or more of the hydroquinone derivatives described in U.S. Pat. Nos. 2,360,290; 2,418,613; 2,675,314; 2,701,197; 2,704,713; 2,710,801; 2,728,659; 2,732,300; 2,735,765 and 2,816,028, the gallic acid derivatives described in U.S. Pat. Nos. 3,457,079 and 3,069,262 and Japanese Patent Publication No. 13496/1968, the p-alkoxyphenols described in U.S. Pat. No. 2,735,765 and Japanese Patent Application No. (OPI) 4738/1972 and the p-oxyphenol derivatives described in U.S. Pat. Nos. 3,432,300; 3,573,050; 3,574,627; 3,698,909 and 3,764,337.

The silver halide emulsion used in this invention can be prepared by mixing an aqueous solution of a water-soluble silver salt such as silver nitrate and an aqueous solution of a water-soluble halide such as potassium bromide in the presence of a water-soluble polymer such as gelatin. Examples of suitable silver halides are silver chloride, silver bromide, silver chlorobromide, silver iodobromide, silver chloroiodobromide, etc. These silver halide grains can be prepared according to any conventional manner and a so-called single jet system, double jet system, or control double jet system can of course be employed.

Also, two or more silver halide emulsions prepared separately can be mixed to produce a silver halide emulsion. Furthermore, the silver halide grains used in this invention can have a uniform crystal structure throughout the entire grain or have a layer structure wherein the interior has a different structure than that of the outer portion of the grain. Furthermore, the silver halide grains can be the so-called conversion type silver halide grains as described in British Pat. No. 635,841 and U.S. Pat. No. 3,622,318. Moreover, the silver halide grains can be the type wherein a latent image is mainly formed on the surfaces of the grains or the type wherein a latent image is mainly formed in the interior of the grains. These silver halide photographic emulsions can be prepared by various methods, such as an ammonia method, a neutralization method, an acid method, etc.

The silver halide emulsion used in this invention can be chemically sensitized. Examples of the chemical sensitizers which can be used for the purpose are, for instance, gold compounds such as auric acid chloride, gold trichloride, etc., as described in U.S. Pat. Nos. 2,399,083; 2,540,085; 2,597,856; and 2,597,915, salts of noble metals such as platinum, palladium, iridium, rhodium, ruthenium, etc., as described in U.S. Pat. Nos. 2,448,060; 2,540,086; 2,566,245; 2,566,263; 2,598,079, etc., sulfur compounds capable of forming silver sulfite by reaction with silver salts as described in U.S. Pat. Nos. 1,544,944; 2,410,689; 3,189,458; and 3,501,313, and stannous salts, amines and other reductive materials as described in U.S. Pat. Nos. 2,487,850; 2,518,698; 2,421,925; 2,521,026; 2,694,637; 2,083,610 and 3,201,254.

The hydrophilic colloids which can be used as the vehicle for the silver halide in this invention include gelatin, colloidal albumin, casein, carboxymethyl cellulose, hydroxyethyl cellulose, agar agar, sodium alginate, starch derivatives, synthetic hydrophilic colloids, e.g., polyvinyl alcohol, poly-N-vinyl pyrrolidone, polyacrylic acid copolymers, polyacrylamide and the derivatives and the partially hydrolized products thereof. If desired, a mixture of two or more these colloids which are compatible with each other can be used. Of the above-described colloids, gelatin is most generally used but a part or all of the gelatin can be replaced with a synthetic polymer. Furthermore, a so-called gelatin derivative, that is to say, gelatin modified by treating the gelatin with a compound having a group capable of reacting with the functional groups of the gelatin molecule, i.e., an amino group, an imino group, a hydroxyl group, and a carboxyl group or also a graft polymer of gelatin formed by bonding the molecular chain of another polymer to the gelatin can be substituted for a part or all of the gelatin.

The silver halide photographic emulsion used in this invention can be subjected to a spectral sensitization or dye sensitization using cyanine dyes such as cyanine, merocyanine or carbocyanine dyes, individually or as a combination thereof. These dye sensitization techniques are well known as disclosed in U.S. Pat. Nos. 2,688,545; 2,912,329; 3,397,060; 3,615,635; 3,628,964; British Pat. Nos. 1,195,302; 1,242,588; and 1,293,862, German Patent Application (OLS) Nos. 2,030,326 and 2,121,780, and Japanese Patent Publication Nos. 4936/1968 and 14030/1969. They can be selected appropriately according to the wave length region to be sensitized, the sensitivity desired and the purposes and uses of the color photographic materials.

Furthermore, various additives can be further added to the above-described photographic emulsions for preventing a reduction in sensitivity of the color photographic materials and formation of fog during the production, storage and processing of the color photographic materials.

These additives include 4-hydroxy-6-methyl-1,3,3a,7-tetraazaindene, 3-methylbenzothiazole, 1-phenyl-5-mercaptotetrazole as well as many other heterocyclic compounds, mercury-containing compounds, mercapto compounds, and metal salts.

The silver halide emulsion further can be hardened using conventional methods. Hardening agents which can be used include aldehyde compounds such as formaldehyde, glutaraldehyde, etc.; ketone compounds such as diacetyl and cyclopentadione; bis(2-chloroethylurea); 2-hydroxy-4,6-dichloro-1,3,5-triazine; compounds having reactive halogens as described in U.S. Pat. Nos. 3,288,775 and 2,732,303 and British Pat. Nos. 974,723 and 1,167,207; divinyl sulfone, 3-acetyl-1,3-diacryloylhexahydro-1,3,5-triazine; and also the various compounds described in U.S. Pat. Nos. 3,635,718 and 3,232,763; British Pat. No. 994,869; and U.S. Pat. Nos. 2,732,316; 2,586,168; 3,103,437; 3,017,280; 2,083,611; 2,725,294; 2,725,295; 3,100,704; 3,091,537; 3,321,313; and 3,543,292.

The above-described silver halide emulsions can further contain surface active agents, either individually or a mixture thereof. These surface active agents can be used as coating aids, dispersing agents, and sensitizers as well as for improving the photographic characteristics, static prevention, and adhesion prevention. These surface active agents include natural surface active agents such as saponin, etc.; nonionic surface active agents such as alkylene oxides, glycerins, glycidols, etc.; anionic surface active agents such as higher alkylamines, quaternary ammonium salts, pyridine, other heterocyclic compounds, phosphoniums, and sulfoniums; and amphoteric surface active agents such as aminoacids, aminosulfonates, sulfuric acid esters or phosphoric acid esters of aminoalcohols, etc.

Some specific examples of surface active agents which can be used in this invention are illustrated in U.S. Pat. Nos. 2,271,623; 2,240,472; 2,288,226; 2,739,891; 3,068,101; 3,158,484; 3,201,253; 3,210,191; 3,294,540; 3,415,649; 3,441,413; 3,442,654; 3,475,174; and 3,545,974, German Patent Application (OLS) No. 1,942,665, and British Pat. Nos. 1,077,317 and 1,198,450.

When the present invention is applied to multilayer color photographic materials, open-chain type diketomethylene compounds are generally used as yellow couplers. These compounds are described in, for instance, U.S. Pat. Nos. 3,341,331; 3,253,924; 3,384,657; 2,778,658; 2,908,573; 3,227,550; 2,875,057; and 3,551,155; German Patent Application (OLS) No. 1,547,868, U.S. Pat. Nos. 3,265,506; 3,582,322; and 3,725,072, German Patent Application (OLS) No. 2,162,899, U.S. Pat. Nos. 3,369,895; 3,227,155; 3,447,928; 3,415,652; and 3,408,194, and German Patent Application (OLS) Nos. 2,057,941; 2,213,461; 2,219,917; 2,261,361; and 2,263,875. Typical examples of suitable yellow couplers which can be used include the following couplers.

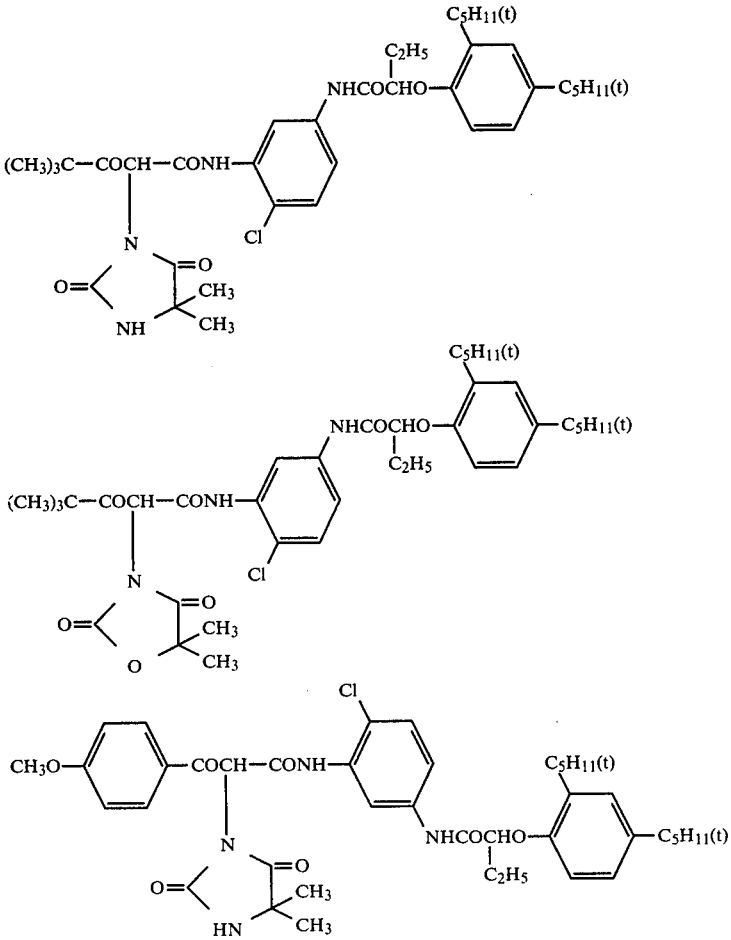

-continued

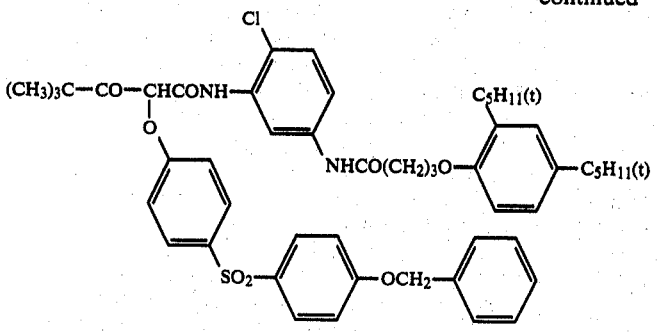

Also, phenol derivatives or naphthol derivatives are mainly used as cyan couplers for color photographic materials. Examples of such derivatives are described in, for instance, U.S. Pat. Nos. 2,369,929; 2,474,293; 2,908,573; 3,619,196; 3,253,294; 3,227,550; 3,419,390; 3,476,563; 2,698,794; 2,895,826; 3,311,476; 3,458,315; 2,423,730; 2,801,171; 3,046,129; 3,516,831; 2,772,162; 3,560,212; 3,582,322; 3,591,383; 3,386,301; 3,632,347; 3,652,286; 3,779,763; 2,434,272; 2,706,684; 3,034,892; and 3,583,971; German Patent Application (OLS) Nos. 2,163,811 and 2,207,468, Japanese Patent Publication Nos. 28836/1970 and 27563/1964, and Japanese Patent Application No. 33228/1973. Typical examples of suitable cyan couplers which can be used include the following couplers

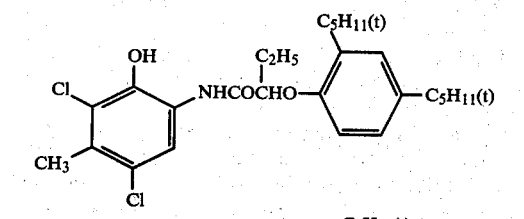

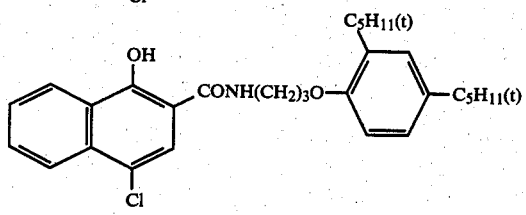

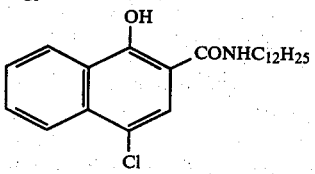

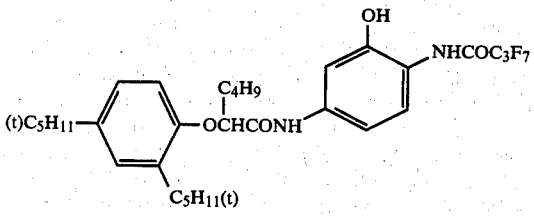

The color photographic material of this invention can contain in the protective layer, interlayers, silver halide emulsion layers, and back layer thereof the ultraviolet absorbents as described in, for instance, U.S. Pat. Nos. 2,685,512; 2,739,888; 2,784,087; 3,253,794; 3,738,837; and 3,754,919.

The photographic silver halide emulsions are coated on a substantially planar material which does not undergo any substantial dimensional change during processing such as a rigid support, e.g, glass, metal and ceramics or a flexible support. Typical examples of flexible supports are cellulose acetate films, cellulose nitrate films, cellulose acetate butyrate films, cellulose acetate propionate films, polystyrene films, polyethylene terephthalate films, polycarbonate films, laminates of these films, thin glass sheets, and papers. Furthermore, barytacoated papers and papers coated or laminated with an olefinic polymer such as, in particular, polyethylene, polypropylene, an ethylene-butene copolymer, and a polymer of an α-olefin having 2 to 10 carbon atoms, can be also used as the flexible support. Also, a synthetic resin film having a roughend surface for improving the adhesive property to other polymers and improving also the printability as described in Japanese Patent Publication No. 19068/1972 can be used. These supports can be transparent or opaque according to the purpose of the photographic materials, and also the transparent support can be colorless or can be colored with a dye or pigment.

Suitable opaque supports include papers which are intrinsically opaque, transparent films opacified with a dye or a pigment such as titanium oxide, the surface treated synthetic resin films as shown in Japanese Patent Publication No. 19068/1972, and papers and synthetic resin films which are rendered completely light-shielding by adding carbon black or a dye thereto. When the adhesion between the support and the silver halide photographic emulsion layer is insufficient, a layer having high adhesion to both the support and the emulsion layer can be formed on the support as a subbing layer. Also, for improving the adhesion of the support, the surface of the support can be pre-treated with, for instance, a corona discharge, ultraviolet radiation, a flame treatment, etc. A suitable silver halide coating amount in one emulsion layer can range from about $5\times10^{-5}$ to $10^{-6}$ mole/m$^2$.

In order to obtain dye images of the color photographic material of this invention, the color photographic material is developed after imagewise exposure. The development process includes fundamentally a color development step, a bleach step, and a fixing step. In this case, each step can be applied independently or two or more of these steps can be performed together using a processing solution with these functions. For instance, the bleach step and the fix step can be carried out in one step using a blix bath. Furthermore, each step can be, if desired, carried by as two or more steps or further the development process can be carried out using the combination of a color development step, a first fixing step, and blixing step. Furthermore, the development process can further include, if desired, a prehardening bath, a neutralization bath, a first development (black and white development), a image stabilization bath, and a washing. The processing temperature is determined appropriately according to the kind of photographic materials and the processing steps, and sometimes the temperature is lower than about 18° C. but usually is higher than about 18° C. Ordinary processing temperatures are about 20° to 60° C., and recently about 30° to 60° C. In addition, it is not always necessary to carry out all of the processing steps at the same temperature.

The color developer used for the development is an alkaline aqueous solution containing a developing agent the oxidation product of which forms a dye-forming compound by reaction with a coupler and having a pH of higher than about 8, preferably a pH of 9 to 12.

The above-described color developing agent is a compound having a primary amino group and the ability to develop exposed silver halide or a precursor thereof capable of forming such a compound. Typical examples of suitable developing agents are 4-amino-N,N-diethylaniline, 3-methyl-4-anilino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-diethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfoamidoethyl-N,N-diethylaniline, and the salts (e.g., sulfates, hydrochlorides, sulfites, p-toluenesulfonates, etc.) thereof. Other examples of developing agents are described in U.S. Pat. Nos. 2,193,015 and 2,592,364, Japanese Patent Application (OPI) No. 64933/1973, and L.F.A. Mason, *Photographic Processing Chemistry,* pages 226–229, Focal Press, London (1966). Also, the above described compounds can be used together with 3-pyrazolidones.

The color developer can, if desired, contain various additives. Examples of these additives are alkalis (e.g., the hydroxides, carbonates, and phosphates of alkali metals and ammonia), pH controlling agents or buffers (e.g., weak acids such as acetic acid and boric acid, weak bases, and the salts thereof), development accelerators (e.g., the pyridinium compounds and cationic compounds as described in U.S. Pat. Nos. 2,648,604 and 3,671,247; potassium nitrate and sodium nitrate; the polyethylene glycol condensates and the derivatives thereof as described in U.S. Pat. Nos. 2,533,990; 2,577,127 and 2,950,970; nonionic compounds such as polythio ethers as described in British Pat. No. 1,020,032; polymers containing a sulfite ester group as described in U.S. Pat. No. 3,068,097; organic amines such as pyridine and ethanolamine; benzyl alcohol; and hydrazines), antifoggants (e.g., alkali metal bromides; alkali metal iodides; nitrobenzoimidazoles, 5-methylbenzotriazoles, and 1-phenyl-5-mercaptobenztriazoles as described in U.S. Pat. Nos. 2,496,940 and 2,656,271; compounds for rapid processing as described in U.S. Pat. Nos. 3,113,864; 3,342,596; 3,295,976; 3,615,522; and 3,597,199; thiosulfonyl compounds as described in British Pat. No. 972,211; the phenazine-N-oxides as described in Japanese Patent Publication No. 41675/1971; and the antifoggants as described in *Kagaku Shashin Binran* (*Handbook of Photographic Science*), 2nd Vol. pages 29–47), stain- or sludge-preventing agents as described in U.S. Pat. Nos. 3,161,513 and 3,161,514 and British Pat. Nos. 1,030,442; 1,144,481; and 1,251,558, and multilayer effect promotors as disclosed in U.S. Pat. No. 3,536,487, and preservatives (e.g., sulfites, acid sulfites, hydroxylamino hydrochloride, formaldehyde-sulfite and alkanolamine-sulfite addition products).

The silver halide photographic material is subjected to a bleach treatment in a conventional manner after the color development and the bleach treatment can be carried out separately from or simultaneously with the bixing treatment. If desired, a fixing agent can be added to the bleach solution to provide a blix solution. Examples of suitable bleaching agents are ferricyanides, dichromates, water-soluble cobalt (III) salts, water-soluble copper(II) salts, water-soluble quinones, nitrosophenols, compounds of polyvalent metals such as iron(III), cobalt(III), and copper(II), the complex salts of these polyvalent metal cations and organic acids (e.g., the metal complex salts of ethylenediamine tetraacetic acid, nitrilotriacetic acid, iminodiacetic acid, N-hydroxyethyl ethylenediaminetriacetic acid, malonic acid, tartaric acid, maleic acid, diglycolic acid, and dithioglycolic acid and the copper complex salt of 2,6-dipicolinic acid, peracids (e.g., alkyl peracids, persulfates, permanganates, hydrogen peroxide, etc.), and hypochlorites, chlorine, bromine, etc. They can be used individually or as a mixture thereof.

Furthermore, the processing solution used for bleaching or blixing can further contain the bleach accelerators as described in U.S. Pat. Nos. 3,042,520 and 3,241,966 and Japanese Pat. Publication Nos. 8506/1970 and 8836/1970.

The formation of dye images using the magenta coupler of this invention is suitable for various kinds of color photographic materials. In one embodiment, a color photographic material comprising a support having thereon a silver halide emulsion layer containing a non-diffusible coupler is processed with an alkaline developer containing a primary aromatic amino color developing agent, whereby a water-insoluble or non-diffusible dye is left in the silver halide emulsion layer. In another embodiment, a color photographic material comprising a support having thereon a silver halide emulsion layer associated with a non-diffusible coupler is processed with an alkaline developer containing a primary aromatic amino color developing agent to form a diffusible dye which is soluble in an aqueous medium and the dye image formed is transferred by imbibition to an image-receiving layer composed of a hydrophilic colloid. In a further embodiment, the coupler is dissolved in an alkaline developer containing a primary aromatic amino color developer and then by processing a color photographic material having a silver halide emulsion layer with the developer, a water-insoluble or non-diffusible dye is left in the silver halide emulsion layer. For instance, Coupler (2) and Coupler (8) can be used in the third embodiment, and the other couplers illustrated above can be used in the first embodiment.

The color photographic materials of this invention include color negative films, color positive films, color reversal films, color papers, etc.

Also, the present invention can be employed in other various photographic materials including color direct positive photographic materials, diffusion transfer color photographic materials, and monochromatic photographic materials.

By applying the method as described in U.S. Pat. Nos. 2,439,901; 2,623,822; 2,814,565; and 3,372,028 in which the developed silver formed by color development is subjected to a halogenation bleach and then color development again to increase the amount of the dye formed or the method as described in Japanese Patent Application (OPI) No. 9728/1973 in which the amount of silver halide in the color photographic material is reduced by a color intensifying method on the color photographic materials containing the couplers of this invention, better results can be obtained.

Valuable results are obtained according to the present invention, some of which are described below (1) The amount of silver required to provide a specific magenta color image density can be reduced, thus reducing the thickness of the light-sensitive layer containing the coupler and improving the sharpness of the image.

(2) The heat resistance of the magenta color image formed is improved using the coupler of the present invention.

(3) A reduction in the cost of production of the light-sensitive material can be achieved by using a reduced amount of silver halide.

(4) Magenta couplers which are more stable to chemical compounds such as formaldehyde or acetone are provided.

(5) Couplers having a high coupling reactivity are provided.

(6) A color image having a lesser fog and stain and superior photographic properties is obtained.

(7) A silver halide color photographic light-sensitive material having good storage stability is obtained by using the coupler of the present invention.

(8) The conversion yield into the dye is improved by using the coupler of the present invention.

The present invention will be further explained by reference to the following examples.

EXAMPLE 1

A mixture of 22.0 g of Coupler (1) of the present invention, 24 ml of dioctyl butyl phosphate and 60 ml of ethyl acetate was heated at 60° C. and the resulting solution was added to 250 ml of an aqueous solution containing 25 g of gelatin and 0.75 g of sodium dodecylbenzenesulfonate at 60° C., followed by vigorous mechanical stirring using a homogenizer, thus obtaining a coupler dispersion. The resulting coupler dispersion was mixed with 200 g of a photographic emulsion containing $11.2\times10^{-2}$ mol of silver chlorobromide (silver bromide 45 mol%, silver chloride 55 mol%) and 20 g of gelatin and, after 10 ml of a 3% acetone solution of triethylenephosphoramide as a hardener was added thereto and the final pH was adjusted to 6.5, the mixture was coated onto a cellulose triacetate film support in a dry thickness of 4.5 microns (Film A). This film contained, per 1 $m^2$, $1.55\times10^{-3}$ mol of the coupler and $6.2\times10^{-3}$ mol of silver chlorobromide.

For comparison, 19.6 g of 1-(2,4,6-trichlorophenyl)-3-[3-(2,4-di-tert-amylphenoxyacetamido)benzamido]-5-oxo-2-pyrazoline (Comparison Coupler A) as a corresponding comparison coupler in which the coupling position was not substituted was dispersed, in place of the above described coupler, in a manner analogous to the above described coupler, mixed with 400 g of the same emulsion as described above and coated onto a film in a dry thickness of 5.1 microns (Film B). This film contained, per 1 $m^2$, $1.57\times10^{-3}$ mol of the coupler.

These films were subjected to stepwise exposure and then to the following processing:

| Color Processing Step | | |
|---|---|---|
| 1. Color Development | 21° C. | 12 min |
| 2. Water Washing | " | 30 sec |
| 3. First Fixing | " | 4 min |
| 4. Water Washing | " | 4 min |
| 5. Bleaching | " | 8 min |
| 6. Water Washing | " | 4 min |
| 7. Second Fixing | " | 4 min |
| 8. Water Washing | " | 6 min |

The processing solutions employed had the following compositions

| Color Developer Solution | (pH 10.7) |
|---|---|
| Sodium Hexametaphosphate | 2 g |
| Sodium Sulfite (anhydrous) | 2 g |
| Benzyl Alcohol | 5 ml |
| Sodium Carbonate (monohydrate) | 27.5 g |
| Potassium Bromide | 0.5 g |
| Hydroxylamine Sulfate | 2.5 g |
| N-Ethyl-N-(β-methanesulfonamidoethyl)-3-methyl-4-aminoaniline Sesquisulfate | 2.5 g |
| Water to make | 1 liter |

| Fixing Solution | (pH 4.5) |
|---|---|
| Sodium Thiosulfate (hexahydrate) | 80 g |
| Sodium Sulfite (anhydrous) | 5 g |
| Borax | 6 g |
| Glacial Acetic Acid | 4 ml |
| Potassium Alum | 7 g |
| Water to make | 1 liter |

| Bleaching Solution | (pH 7.2) |
|---|---|
| Potassium Ferricyanide | 100 g |
| Potassium Bromide | 5 g |
| Boric Acid | 10 g |
| Borax | 5 g |
| Water to make | 1 liter |

After the processing, the optical density of these films was measured with green light to obtain the photographic properties as shown in Table 1. A clear color image was obtained having an absorption maximum of 542 mμ.

Table 1

| Film | Coupler | Coating Amount (mol/$m^2$) Coupler | Coating Amount (mol/$m^2$) AgX | AgX/Coupler (molar ratio) | Thickness (μ) | Fog | Gamma | Relative Sensitivity* | Maximum Color Density |
|---|---|---|---|---|---|---|---|---|---|
| A | (1) | $1.55\times10^{-3}$ | $6.2\times10^{-3}$ | 4 | 4.5 | 0.02 | 2.95 | 100 | 3.12 |
| B | A | $1.57\times10^{-3}$ | $12.6\times10^{-3}$ | 8 | 5.1 | 0.03 | 2.35 | 97 | 2.38 |

*Relative sensitivity means the quantity of exposure necessary for providing a density of fog +0.1

As is evident from the results in Table 1, the coupler of the present invention provided a higher sensitivity and gradation as well as a maximum color density, even when the ratio of silver halide/coupler was decreased to about ½. The above results demonstrate that in using the coupler of the present invention, the quantity of developed silver necessary for obtaining a color image having a specific density can be reduced. That is, the quantities of the coupler and coated silver halide necessary for obtaining a specific maximum color density can be reduced and the developing time can be shortened.

EXAMPLE 2

Using Film A and Film B as shown in Example 1, the following processing was carried out;

| Color Processing Step | | |
|---|---|---|
| 1. Color Development | 30° C. | 4 min |
| 2. Blixing | " | 2 min |
| 3. Water Washing | " | 2 min |
| 4. Stabilizing Bath | " | 2 min |

The photographic properties of the thus obtained films are shown in Table 2.

Moreover, two kinds of stabilizing baths, i.e., Stabilizing Bath (a) which did not contain formaldehyde and Stabilizing Bath (b) containing 1% of a 40% aqueous solution of formaldehyde were employed. The films were treated with these baths, allowed to stand at 80° C. for one week and the ratio of the density, deciease based on the initial density was determined; the results and shown in Table 3.

The processing composition used had the following formulations:

| Color Developer Solution | (pH 10.2) | |
|---|---|---|
| Sodium Metaborate | 25 | g |
| Sodium Sulfite | 2 | g |
| Hydroxylamine (sulfate) | 2 | g |
| Potassium Bromide | 0.5 | g |
| 6-Nitrobenzimidazole (nitrate) | 0.02 | g |
| Sodium Hydroxide | 4 | g |
| Benzyl Alcohol | 15.8 | ml |
| Diethylene Glycol | 20 | ml |
| 4-(N-Ethyl-N-β-methanesulfonamidoethyl)-amino-2-methylaniline Sesquisulfate | 8 | g |
| Water to make | 1 | liter |

| Blixing Solution | | |
|---|---|---|
| Ferric Ethylenediaminetetraacetate | 45 | g |
| Ammonium Thiocyanate | 10 | g |
| Sodium Sulfite | 10 | g |
| Ammonium Thiosulfate (60% aq. soln.) | 100 | ml |
| Sodium Ethylenediaminetetraacetate | 5 | g |
| Water to make | 1 | liter |

| Stabilizing Bath (a) | |
|---|---|
| Tartaric Acid | 10 g |
| Zinc Sulfate | 10 g |
| Sodium Metaborate | 20 g |
| Water to make | 1 liter |

| Stabilizing Bath (b) | |
|---|---|
| Tartaric Acid | 10 g |
| Zinc Sulfate | 10 g |
| Sodium Metaborate | 20 g |
| Formaldehyde (40% aq. soln.) | 10 ml |
| Water to make | 1 liter |

Table 2

| Film | Coupler | Photographic Property (Stabilizing Bath (a)) Fog | Gamma | Maximum Color Density |
|---|---|---|---|---|
| A | (1) | 0.03 | 2.80 | 3.15 |
| B | A | 0.03 | 2.25 | 2.35 |

Table 3

| Film | Stabilizing Bath | Durability of Color Image (80° C., Standing for One Week) Initial Density 0.5 (%) | 1.0 (%) | 2.0 (%) |
|---|---|---|---|---|
| A | a | 11 | 9 | 6 |
| | b | 10 | 8 | 5 |
| B | a | 54 | 38 | 10 |
| | b | 11 | 8 | 6 |

The results in Table 2 show that the use of Film A results in a sufficient photographic property even though a strong oxidizing agent is not used as in the processing of Example 1, and that Film A has superior properties to Film B. The results in Table 3 show that Film A has sufficient heat durability even though the film was not subjected to a stabilizing bath treatment containing formaldehyde as in the prior art.

EXAMPLE 3

Onto a baryta paper resin-coated with polyethylene were coated, as a first layer, a blue-sensitive silver chlorobromide emulsion containing α-pivaloyl-α-(2,4-dioxo-5,5-dimethyloxazolidin-3-yl)-2-chloro-5-[α-(2,4-di-tert-amylphenoxy)butyramido]acetanilide in a dry thickness of 3.0 microns (coupler coated amount: $1.18\times10^{-3}$ mol/m$^2$; silver coated amount: $3.53\times10^{-3}$ mol/m$^2$; silver bromide: 70 mol%, silver chloride: 30 mol%) and further, as a second layer, a layer of gelatin containing 2-tert-octylhydroquinone in a dry thickness of 1.5 microns (hydroquinone compound coated amount: 0.05 g/m$^2$).

A mixture of 8.7 g of Coupler (19) of the present invention, 0.8 g of 2,5-di-tert-octylhydroquinone, 0.8 g of 6,6'-dihydroxy-7,7'-dimethyl-4,4,4',4'-tetramethyl-bis-2,2'-spirochroman, 10 ml of tricresyl phosphate and 30 ml of ethyl acetate was heated and dissolved on a steam bath and added to an aqueous solution containing 10 g of gelatin and 0.5 g of sodium cetylsulfate, followed by vigorous mechanical stirring, thus obtaining a coupler dispersion. This coupler dispersion was mixed with 100 g of a photographic emulsion containing $4.7\times10^{-2}$ mol of silver chlorobromide (silver chloride: 50 mol%, silver bromide: 50 mol%) and 9 g of gelatin, to which 3 ml of a 4% aqueous solution of 2-hydroxy-4,6-dichloro-S-triazine sodium salt as a hardener was then added, and the pH was adjusted to 6.3. The resulting mixture was coated in a dry thickness of 1.9 microns as a third layer (coupler coated amount: $4.7\times10^{-4}$ mol/m$^2$; silver coated amount: $1.88\times10^{-3}$ mol/m$^2$).

Then, a gelatin layer containing 2,5-di-tert-octylhydroquinone and, as an ultraviolet absorbant, 2-(5-chlorobenzotriazol-2-yl)-4-methyl-6-tert-butylphenol and 2-(benzotriazol-2-yl)-4-tert-butylphenol, was coated in a dry thickness of 2.5 microns as a fourth layer (hydroquinone compound coated amount: 0.05 g/m$^2$; benzotriazole compound coated amount: 0.4 g/m$^2$, each), a red-sensitive emulsion containing 2-[α-(2,4-di-tert-amylphenoxy)butyramido]-4,6-dichloro-5-methylphenol was coated in a dry thickness of 2.5 microns as a fifth layer (coupler coated amount: $0.98\times10^{-3}$ mol/m$^2$; silver coated amount: $2.94\times10^{-3}$ mol/m$^2$; silver bromide 50 mol%, silver chloride 50 mol%) and gelatin was then coated in a dry thickness of 1.0 micron as an uppermost layer, thus preparing a color print paper (Film C).

For comparison, another coupler dispersion was prepared in the same manner as described above but using 7.6 g of a 4-position unsubstituted corresponding comparison coupler, i.e., 1-(2,6-dichloro-4-methoxyphenyl)-3-[α-(3-pentadecylphenoxy)butyramido]-5-oxo-2-pyrazoline (Comparison Coupler B), in place of Coupler (19) in the third layer of Film C, mixed with 200 g of an emulsion having the same composition and coated in a dry thickness of 3.0 microns for a third layer and thus another color print paper was prepared (Film D). In the third layer, $7.5\times10^{-4}$ mol of the coupler and $6.0\times10^{-3}$ mol of the silver halide were coated per 1 m$^2$.

When these samples were subjected to stepwise exposure and processing as in Example 2 (Stabilizing Bath(a)) and the reflection density was measured with green light, the photographic properties as shown in Table 4 were obtained. A clear color image of a main wavelength of 542 mμ was obtained.

Table 4

| Film | Coupler | Coating Amount (mol/m$^2$) Coupler | Coating Amount (mol/m$^2$) AgX | AgX/Coupler (molar ratio) | Photographic Properties Fog | Gamma | Relative Sensitivity | Maximum Color Density |
|---|---|---|---|---|---|---|---|---|
| C | (19) | $4.7\times10^{-4}$ | $1.88\times10^{-3}$ | 4 | 0.05 | 2.38 | 100 | 2.7 |
| D | B | $7.5\times10^{-4}$ | $6.0\times10^{-3}$ | 8 | 0.05 | 2.40 | 98 | 2.40 |

It is apparent from the results in Table 4 that the light-sensitive material using the coupler of the present invention provides similar photographic properties to those of the prior art even though the coating amount of the coupler and silver halide are reduced.

The light durability when the thus obtained developed films were exposed to a daylight-type fluorescent lamp of 30,000 lux through a filter capable of absorbing substantially all ultraviolet light having a wavelength of 400 mμ or less for 12 days, the heat durability when these films were allowed to stand at 80° C. in the dark for one week and the humidity durability when these films were stored in the dark at 60° C. and 75% RH (relative humidity) for two weeks are shown in Table 5 by the decreasing ratio of density (%) based on the initial density.

Table 5

| Film | Coupler | Durability of Color Image (Density Decreasing Ratio %) Fluorescent Lamp 12 days, Initial Density 0.5 (%) | 1.0 (%) | 2.0 (%) | 80° C., 1 Week, Initial Density 0.5 (%) | 1.0 (%) | 2.0 (%) | 60° C., 75% RH 2 Weeks, Initial Density 0.5 (%) | 1.0 (%) | 2.0 (%) |
|---|---|---|---|---|---|---|---|---|---|---|
| C | (19) | 18 | 12 | 6 | 8 | 5 | 3 | 6 | 4 | 3 |
| D | B | 23 | 17 | 8 | 55 | 29 | 8 | 24 | 15 | 6 |

It is apparent from these results that in using the coupler of the present invention, an image can be obtained which is durable to heat, light, high temperature and high humidity.

While the invention has been described in detail and with reference to specific embodiments thereof, it will be apparent to one skilled in the art that various changes and modifications can be made therein without departing from the spirit and scope thereof.

What is claimed is:

1. A photographic silver halide emulsion containing a photographic magenta coupler represented by the following general formulae (IV), (V), (VI) or (VII)

(IV)

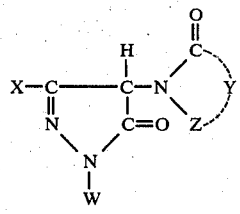

(V)

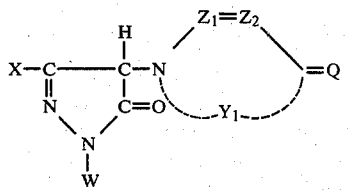

(VI)

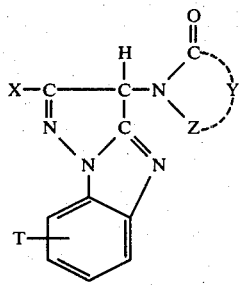

-continued

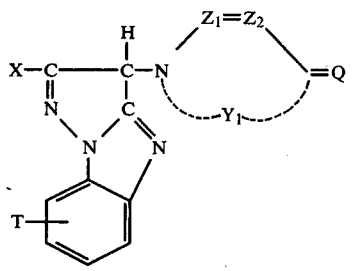

(VII)

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyl group, an alkylsulfonyl group, an arylsulfonyloxy group, an alkylsulfonyloxy group, an arylthio group, an alkylthio group, an alkylsulfinyl group, an arylsulfinyl group, an alkylamino group, a dialkylamino group, an anilino group, an N-aryl-anilino group, an N-alkylanilino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyloxy group, an alkylsulfonyloxy group, an arylsulfonyl group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the aryl group; an acyl group; a thioacyl group; an alkyl sulfonyl group; an arylsulfonyl group; an alkylsulfinyl group; an arylsulfinyl group; a carbamoyl group; and a thiocarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups for W; an aryl group which can be substituted with one or more of the substituents described above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group; an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

T represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups of W; an aryl group which can be substituted with one or more of the substituents described above for the aryl group of W; a heterocyclic group which can be substituted with one or more of the substituents described above for the heterocyclic group for W; a cyano group, an alkoxy group, an aryloxy group, a halogen atom, a carboxy group, an alkoxycarbonyl group, an aryloxycarbonyl group, an alkylthiocarbonyl group, an arylthiocarbonyl group, a sulfo group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, an alkylsulfonyloxy group, an arylsulfonyloxy group, an arylsulfonyl group, an alkylsulfonyl group, an arylthio group, an alkylsulfinyl group, an arylsulfinyl group; an alkylamino group; a dialkylamino group, an anilino group, an N-arylanilino group, an N-alkylanilino group, an N-acylanilino group, a hydroxy group and a mercapto group;

Y represents the non-metallic atoms necessary to form, with Z and the

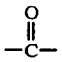

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, —N=; an imino group which can be substituted with a substituent having up to 40 carbon atoms selected from the group consisting of a straight chain or a branched chain alkyl group, an alkenyl group, a cycloalkyl group, an aralkyl group, a cycloalkenyl group, an aryl group, a heterocycylic group, an acyl group, a thioacyl group, an alkylsulfonyl group, an arylsulfonyl group, an alkylsulfinyl group, an arylsulfinyl group, a carbamoyl group, or a thiocarbamoyl group;

Z represents a sulfoxide group, a methylene group which can be substituted with a substituent as described for the substituted alkylene group for Y, —N=, an imino group which can be substituted with a substituent as described for the substituted imino group for Y, an oxygen atom, a sulfur atom, or a methine group which can be substituted with a substituent as described for the substituted methine group for Y;

$Z_1$ and $Z_2$, which can be the same or different, each represents —N= or a methine group which can be substituted with a substituent as defined for the substituted methine group for Y, where the nitrogen containing ring composed of $Z_1$ and $Z_2$ can be part of a condensed ring;

$Q_1$ represents an oxygen atom or imino group; and $Y_1$ represents an ethylene group, a methylene group, or an alkenylene group, in which these groups can be substituted with a substituent as described for the substituted alkylene group or the substituted alkenylene group for Y; an oxygen atom; a sulfur atom; or an imino group which can be substituted with a substituent as described for the substituted imino group for Y.

2. A photographic light-sensitive material comprising a support having thereon the photographic silver halide emulsion as claimed in claim 1.

3. The photographic silver halide emulsion of claim 1, containing the photographic magenta coupler represented by the following general formula (IV):

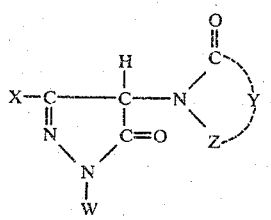

(IV)

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, a sulfonamido group, a heterocyclic group, an arylsulfonyl group, an alkylsulfonyl group, an arylsulfonyloxy group, an alkylsulfonyloxy group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group a thioureido group, an alkoxycarbonylamino group, an arylalkoxycarbonylamino group, an alkoxy(thiocarbonyl-)amino group, an arylalkoxy(thiocarbonyl)amino group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the aryl group; an acyl group; a thioacyl group; an alkylsulfonyl group; an arylsulfonyl group; an alkylsulfinyl group; an arylsulfinyl group; a carbamoyl group; and a thicarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups for W; an aryl group which can be substituted with one or more of the substituents described above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group; an aryloxy group, an alkylthio group, an arylthio group, a carboxy group, an acylamino group, a diacylamino group; an N-alkylacylamino group, an N-arylacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

Y represents the non-metallic atoms necessary to form with Z and the

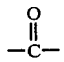

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, —N=; an imino group which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an acyl group, a thioacyl group, an alkylsulfonyl group, an arylsulfonyl group, an alkylsulfinyl group, an arylsulfinyl group, a carbamoyl group, or a thiocarbamoyl group; and Z represents a sulfoxide group, a methylene group which can be substituted with a substituent as described for the substituted alkylene group for Y, —N=, an imino group which can be substituted with a substituent as described for the substituted imino group for Y, an oxygen atom, a sulfur atom, or a methine group which can be substituted with a substituent as described for the substituted methine group for Y.

4. A photographic light-sensitive material comprising a support having thereon the photographic silver halide emulsion as claimed in claim 5.

5. A photographic light-sensitive material comprising a support having thereon a blue-sensitive silver halide emulsion layer containing a yellow color forming coupler, a green-sensitive silver halide emulsion layer containing a photographic magenta coupler represented by the following general fomulae (IV), (V), (VI) or (VII)

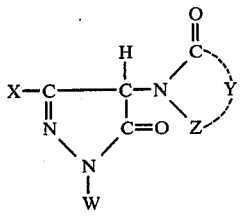

(IV)

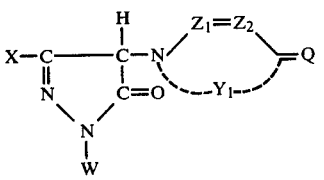

(V)

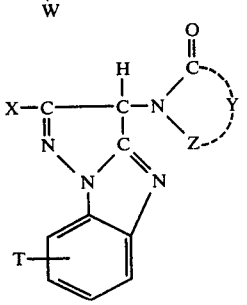

(VI)

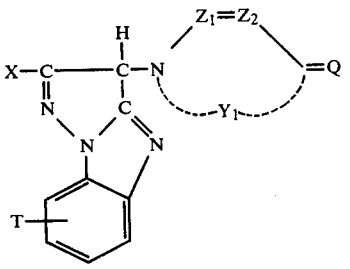

(VII)

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, a sulfonamido group, a heterocyclic group, an arylsulfonyl group, an alkylsulfonyl group, an arylsulfonyloxy group, an alkoylsulfonyloxy group, an alkylsulfonyloxy group, an arylthio group, an alkylthio group, an alkylsulfinyl group, an arylsulfinyl group, an alkylamino group, a dialkylamino group, an anilino group, an N-arylanilino group, an N-alkylamino group, an N-alkylamino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxy carbonylamino group, an alkoxy(thiocarbonyl)amino group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the aryl group; an acyl group; a thioacyl group; an alkylsulfonyl group; an arylsulfonyl group; an alkylsulfinyl group; an arylsulfinyl group; a carbamoyl group; and a thicarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups for W; an aryl group which can be substituted with one or more of the substituents deacribed above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

T represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups of W; an aryl group which can be substituted with one or more of the substituents described above for the aryl group of W; a heterocyclic group which can be substituted with one or more of the substituents described above for the heterocyclic group for W; a cyano group, an alkoxy group, an aryloxy group, a halogen atom, a carboxy group, an alkoxycarbonyl group, an arylcarbonyl group, an alkylthiocarbonyl group, an arylthiocarbonyl group, a sulfo group, a sulfamoyl group, a carbamoyl group, an acylamino group, a diacylamino group, an ureido group, a thioureido group, an alkoxycarbonyl amino group, an arylalkoxycarbonylamino group, an alkoxy(thiocarbonyl)amino group, an arylalkoxy(thiocarbonyl)amino group, a sulfonamido group, an alkylsulfonyloxy group, an arylsulfonyloxy group, an arylsulfonyl group, an alkylsulfonyl group, an arylthio group, an alkylsulfinyl group, an arylsulfinyl group; an alkylamino group; a dialkylamino group, an anilino group, an N-arylanilino group, an N-alkylaniline group, an N-acylanilino group, a hydroxy group and a mercapto group;

Y represents the non-metallic atoms necessary to form, with Z and the $$-\overset{\overset{\displaystyle O}{\|}}{C}-$$

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, —N═; an imino group which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an acyl group, a thioacyl group, an alkylsulfonyl group, an arylsulfonyl group, an alkylsulfinyl group, an arylsulfinyl group, a carbamoyl group, or a thiocarbamoyl group;

Z represents a sulfoxide group, a methylene group which can be substituted with a substituent as described for the substituted alkylene group for Y, —N═, an imino group which can be substituted with a substituent as described for the substituted imino group for Y, an oxygen atom, a sulfur atom, or a methine group which can be substituted with a substituent as described for the substituted methine group for Y;

$Z_1$ and $Z_2$, which can be the same or different, each represents —N═ or a methine group which can be substituted with a substituent as defined for the substituted methine group for Y, where the nitrogen containing ring composed of $Z_1$ and $Z_2$ can be part of a condensed ring;

$Q_1$ represents an oxygen atom or imino group; and $Y_1$ represents an ethylene group, a methylene group, or an alkenylene group, in which those groups can be substituted with a substituent as described for the substituted alkylene group or the substituted alkenylene group for Y; an oxygen atom; a sulfur atom; or an imino group which can be substituted with a substituent as described for the substituted imino group for Y.

6. The photographic light-sensitive material of claim 5, wherein said green-sensitive silver halide emulsion layer contains said magenta coupler represented by the following general formula (IV):

(IV)

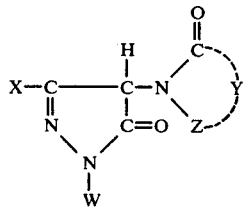

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, a sulfonamido group, a heterocyclic group, an arylsulfonyl group, an alkylsulfonyl group, an arylsulfonyloxy group, an alkylsulfonyloxy group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group a thioureido group, an alkoxycarbonylamino group, an arylalkoxycarbonylamino group, an alkoxy(thiocarbonyl-)amino group, an arylalkoxy(thiocarbonyl)amino group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the aryl group; an acyl group; a thioacyl group; an alkylsulfonyl group; an arylsulfonyl group; an alkylsulfinyl group; an arylsulfinyl group; a carbamoyl group; and a thicarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups for W; an aryl group which can be substituted with one or more of the substituents described above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group; an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

Y represents the non-metallic atoms necessary to form with Z and the

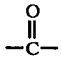

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl-)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, —N=; an imino group which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an acyl group, a thioacyl group, an alkylsulfonyl group, an arylsulfonyl group, an alkylsulfinyl group, an arylsulfinyl group, a carbamoyl group, or a thiocarbamoyl group; and Z represents a sulfoxide group, a methylene group which can be substituted with a substituent as described for the substituted alkylene group for Y, —N=, an imino group which can be substituted with a substituent as described for the substituted imino group for Y, an oxygen atom, a sulfur atom, or a methine group which can be substituted with a substiuent as described for the substituted methine group for Y.

7. A photographic color developer solution containing a primary aromatic amine developing agent and the photographic magenta coupler represented by the following general formulae (IV), (V), (VI) or (VII)

(IV)

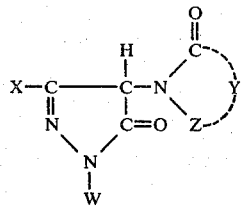

(V)

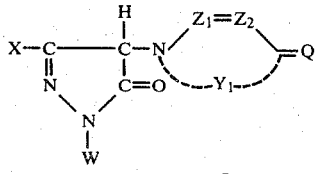

(VI)

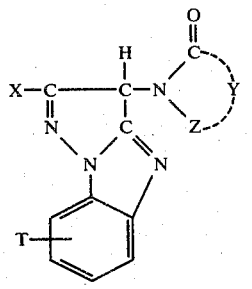

(VII)

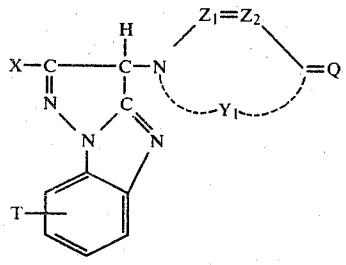

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyl group, an alkylsulfonyl group, an arylsulfonyloxy group, an alkylsulfonyloxy group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the aryl group; an acyl group; a thioacyl group; an alkylsulfonyl group; an arylsulfonyl group; an alkylsulfinyl group; an arylsulfinyl group; a carbamoyl group; and a thicarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups for W; an aryl group which can be substituted with one or more of the substituents described above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group; an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

T represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups of W; an acyl group which can be substituted with one or more of the substituents described above for the aryl group of W; a heterocyclic group which can be substituted with one or more of the substituents described above for the heterocyclic group for W; a cyano group, an alkoxy group, an aryloxy group, a halogen atom, a carboxy group, an alkoxycarbonyl group, an aryloxycarbonyl group, an acyloxy group, an alkylcarbonyl group; an arylcarbonyl group, an alkylthiocarbonyl group, an arylthiocarbonyl group, a sulfo group, a sulfamoyl group, carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, an alkylsulfonyloxy group, an arylsulfonyloxy group, an arylsulfonyl group, an alkylsulfonyl group, an arylthio group, an alkylsulfinyl group, an arylsulfinyl group; an alkylamino group; a dialkylamino group, an anilino group, an N-arylanilino group, an N-alkylanilino group, an N-acylanilino group, a hydroxy group and a mercapto group;

Y represents the non-metallic atoms necessary to form, with Z and the

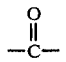

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, —N=; an imino group which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an acyl group, a thioacyl group, an alkylsulfonyl group, an arylsulfonyl group, an alkylsulfinyl group, an arylsulfinyl group, a carbamoyl group, or a thiocarbamoyl group;

Z represents a sulfoxide group, a methylene group which can be substituted with a substituent as described for the substituted alkylene group for Y, —N=, an imino group which can be substituted with a substituent as described for the substituted imino group for Y, an oxygen atom, a sulfur atom, or a methine group which can be substituted with a substituent as described for the substituted methine group for Y;

$Z_1$ and $Z_2$, which can be the same or different, each represents —N= or a methine group which can be substituted with a substituent as defined for the substituted methine group for Y, where the nitrogen containing ring composed of $Z_1$ and $Z_2$ can be part of a condensed ring;

$Q_1$ represents an oxygen atom or imino group; and $Y_1$ represents an ethylene group, a methylene group, or an alkenylene group, in which these groups can be substituted with a substituent as described for the substituted alkylene group or the substituted alkenylene group for Y; an oxygen atom; a sulfur atom; or an imino group which can be substituted with a substituent as described for the substituted imino group for Y.

8. The photographic color developer solution of claim 7, containing said magenta coupler represented by the following general formula (IV):

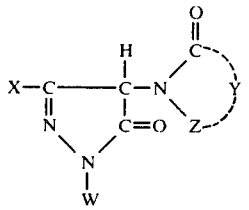

(IV)

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyl group, an alkylsulfonyl group, an arylsulfonyloxy group, an alkylsulfonyloxy group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the acyl group; an acyl group; a thioacyl group; an alkylsulfonyl group; an arylsulfonyl group; an alkylsulfinyl group; an arylsulfinyl group; a carbamoyl group; and a thicarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups for W; an aryl group which can be substituted with one or more of the substituents described above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group; an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

Y represents the non-metallic atoms necessary to form with Z and the

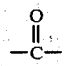

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, —N=; an imino group which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an acyl group, a thioacyl group, an alkylsulfonyl group, an arylsulfonyl group, an alkylsulfinyl group, an arylsulfinyl group, a carbamoyl group, or a thiocarbamoyl group; and Z represents a sulfoxide group, a methylene group which can be substituted with a substituent as described for the substituted alkylene group for Y, —N=, an imino group which can be substituted with a substituent as described for the substituted imino group for Y, an oxygen atom, a sulfur atom, or a methine group which can be substituted with a substituent as described for the substituted methine group for Y.

9. A method of forming a magenta color image which comprises developing an exposed silver halide photographic light-sensitive material with an aromatic primary amino color developing agent in the presence of the photographic magenta coupler represented by the following general formulae (IV), (V), (VI) or (VII)

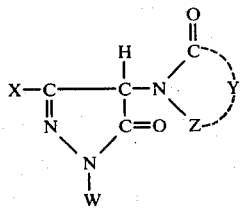

(IV)

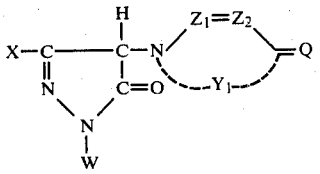

(V)

-continued (VI)

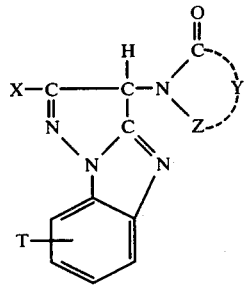

(VII)

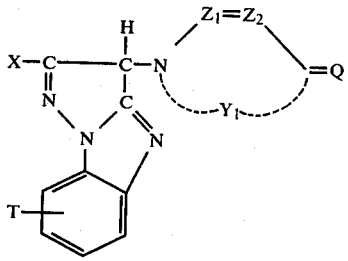

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyl group, an alkylsulfonyl group, an arylsulfonyloxy group, an alkylsulfonyloxy group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the aryl group; an acyl group; a thioacyl group; an alkylsulfonyl group; an arylsulfonyl group; an alkylsulfinyl group; an arylsulfinyl group; a carbamoyl group; and a thicarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for those groups for W; an aryl group which can be substituted with one or more of the substituents described above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group; an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

T represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups of W; an aryl group which can be substituted with one or more of the substituents described above for the aryl group of W; a heterocyclic group which can be substituted with one or more of the substituents described above for the heterocyclic group for W; a cyano group, an alkoxy group, an aryloxy group, a halogen atom, a carboxy group, an alkoxycarbonyl group, an aryloxycarbonyl group, an acyloxy group, an alkylcarbonyl group, an arylcarbonyl group, an alkylthiocarbonyl group, an arylthiocarbonyl group, a sulfo group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, an alkylsulfonyloxy group, an arylsulfonyloxy group, an arylsulfonyl group, an alkylsulfonyl group, an arylthio group, an alkylsulfinyl group, an arylsulfinyl group; an alkylamino group; a dialkylamino group, an anilino group, an N-arylanilino group, an N-alkylanilino group, an N-acylanilino group, a hydroxy group and a mercapto group;

Y represents the non-metallic atoms necessary to form, with Z and the

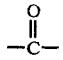

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, -N=; an imino group which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an acyl group, a thioacyl group, an alkylsulfonyl group, an arylsulfonyl group, an alkylsulfinyl group, an arylsulfinyl group, a carbamoyl group, or a thiocarbamoyl group;

Z represents a sulfoxide group, a methylene group which can be substituted with a substituent as described for the substituted alkylene group for Y, —N=, an imino group which can be substituted with a substituent as described for the substituted imino group for Y, an oxygen atom, a sulfur atom, or a methine group which can be substituted with a substituent as described for the substituted methine group for Y;

$Z_1$ and $Z_2$, which can be the same or different, each represents —N= or a methine group which can be substituted with a substituent as defined for the substituted methine group for Y, where the nitrogen containing ring composed of $Z_1$ and $Z_2$ can be part of a condensed ring;

$Q_1$ represents an oxygen atom or imino group; and $Y_1$ represents an ethylene group, a methylene group, or an alkenylene group, in which those groups can be substituted with a substituent as described for the substituted alkylene group or the substituted alkenylene group for Y; an oxygen atom; a sulfur atom; or an imino group which can be substituted with a substituent as described for the substituted imino group for Y.

10. The method of forming the magenta color image of claim 9, wherein said magenta coupler is represented by the general formula (IV):

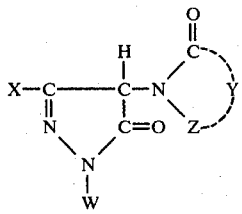

(IV)

wherein W represents a hydrogen atom, or has up to 40 carbon atoms and represents a straight chain or branched chain alkyl group, an alkenyl group, a cycloalkyl group, an aralkyl group or a cycloalkenyl group, in which each of these groups can be substituted with one or more of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyl group, an alkylsulfonyl group, an arylsulfonyloxy group, an alkylsulfonyloxy group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group or a mercapto group; an aryl group, which can be substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, an ureido group a thioureido group, an alkoxycarbonylamino group, an arylalkoxycarbonylamino group, an alkoxy(thiocarbonyl)amino group, an arylalkoxy(thiocarbonyl)amino group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group; a heterocyclic group, which can be substituted with one or more of the substituents described above for the aryl group; an acyl group; a thioacyl group; an alkylsulfonyl group; an arylsulfonyl group; an alkylsulfinyl group; an arylsulfinyl group; a carbamoyl group; and a thicarbamoyl group, X represents a hydrogen atom; or has up to 40 carbon atoms and represents a straight chain or branched chain alkyl group, an alkenyl group, a cycloalkyl group, an aralkyl group, or a cycloalkenyl group, in which each of these groups can be substituted with one or more of the substituents described above for these groups for W; an aryl group which can be substituted with one or more of the substituents described above for the aryl group of W; a heterocyclic group which can be substituted with one or more of the substituents described above for the heterocyclic group for W; an alkoxycarbonyl group; an aryloxycarbonyl group, an aralkyloxycarbonyl group, an alkoxy group; an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy group, a mercapto group, a halogen atom or a sulfo group;

Y represents the non-metallic atoms necessary to form, with Z and the

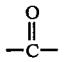

moiety, a 5-membered or 6-membered ring and is an alkylene group, an alkenylene group, or a methine group, which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, a thioureido group, an alkoxycarbonylamino group, an arylalkoxycarbonylamino group, an alkoxy(thiocarbonyl)amino group, an arylalkoxy(thiocarbonyl)amino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, a hydroxy group, a mercapto group, a halogen atom or a sulfo group, an oxygen atom, a sulfur atom, a sulfonyl group, a sulfoxide group, —N=; an imino group which can be substituted with a substituent having up to 40 carbon atoms selected from the group consisting of a straight chain or branched chain alkyl group, an alkenyl group, a cycloalkyl group, an aralkyl group, a cycloalkenyl group, an aryl group, a heterocyclic group, an acyl group, a thioacyl group, an alkylsulfonyl group, an arylsulfonyl group, an alkylsulfinyl group, an arylsulfinyl group, a carbamoyl group, or a thiocarbamoyl group; and Z represents a sulfoxide group, a methylene group which can be substituted with a substituent as described for the substituted alkylene group for Y, —N=, an imino group which can be substituted with a substituent as described for the substituted imino group for Y, an oxygen atom, a sulfur atom or a methine group which can be substituted with a substituent as described for the substituted methine group for Y.

11. A photographic silver halide emulsion containing a photographic magenta coupler represented by the following general formula (IV)

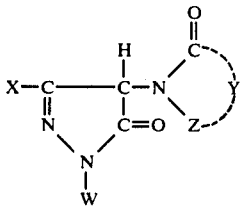

(IV)

wherein W represents an aryl group; X represents an anilino group; Z represents a methine group and Y represents an alkenylene group that will form a six-membered ring with Z and the

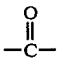

moiety.

12. A photographic light-sensitive material comprising a support having thereon the photographic silver halide emulsion as claimed in claim 11.

13. The photographic light-sensitive material of claim 11 wherein said green-sensitive silver halide emulsion layer contains said magenta coupler wherein W represents an aryl group; X represents an anilino group; Z represents a methine group and Y represents an alkenylene group that will form a six-membered ring with Z and the

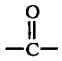

moiety.

14. A photographic color developer solution containing a primary aromatic amine developing agent and a photographic magenta coupler represented by the following general formula (IV)

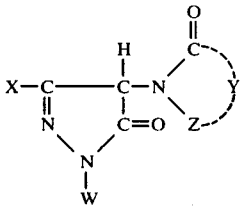

(IV)

wherein W represents an aryl group; X represents an ainino group; Z represents a methine group and Y represents an alkenylene group that will form a six-membered ring with Z and the

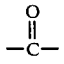

moiety.

15. A method of forming a magenta color image which comprises developing an exposed silver halide photographic light-sensitive material with an aromatic primary amino color developing agent in the presence of a photographic magenta coupler represented by the following general formula (IV)

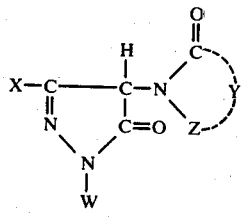

(IV)

wherein W represents an aryl group; X represents an anilino group; Z represents a methine group and Y represents an alkenylene group that will form a six-membered ring with Z and the

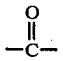

moiety.

* * * * *